US007100862B2

(12) United States Patent
Skarzenski et al.

(10) Patent No.: US 7,100,862 B2
(45) Date of Patent: Sep. 5, 2006

(54) ROLL-UP MACHINE AND METHOD

(75) Inventors: Joseph Skarzenski, Ottawa (CA); Witold S. Czastkiewicz, Ottawa (CA); Erkki Paivinen, Ottawa (CA); Stan Banaszkiewicz, Ottawa (CA)

(73) Assignee: Ottawa Fibre, Inc., Ottawa (CA)

( * ) Notice: Subject to any disclaimer, the term of this patent is extended or adjusted under 35 U.S.C. 154(b) by 142 days.

(21) Appl. No.: 10/654,255

(22) Filed: Sep. 3, 2003

(65) Prior Publication Data

US 2005/0056163 A1 Mar. 17, 2005

(51) Int. Cl.
*B30B 5/06* (2006.01)

(52) U.S. Cl. ..... 242/541.3; 100/87; 100/88

(58) Field of Classification Search ..... 242/541.3; 100/87, 88

See application file for complete search history.

(56) References Cited

U.S. PATENT DOCUMENTS

| | | | | | |
|---|---|---|---|---|---|
| 2,789,406 | A | | 4/1957 | Moiser | 53/118 |
| 2,927,742 | A | | 3/1960 | Overman | 242/55.1 |
| 3,133,386 | A | | 5/1964 | Johnston | 53/26 |
| 3,458,966 | A | | 8/1969 | Dunbar et al. | 53/24 |
| 3,717,973 | A | | 2/1973 | Brady, Jr. | 53/124 E |
| 3,808,771 | A | | 5/1974 | Drella et al. | 53/118 |
| 3,911,641 | A | | 10/1975 | Miller et al. | 53/21 FW |
| 3,957,220 | A | * | 5/1976 | Beck et al. | 242/528 |
| 3,964,232 | A | | 6/1976 | Bender et al. | 53/21 FW |
| 3,964,235 | A | | 6/1976 | Miller et al. | 53/118 |
| 3,991,538 | A | | 11/1976 | Finn et al. | 53/21 FW |
| 4,114,530 | A | * | 9/1978 | Miller | 100/87 |
| 4,163,353 | A | | 8/1979 | Finn et al. | 53/430 |
| 4,164,177 | A | | 8/1979 | Canfield | 100/40 |
| 4,444,311 | A | | 4/1984 | Rias | 206/391 |
| 4,535,587 | A | | 8/1985 | Rias | 53/436 |
| 4,549,481 | A | * | 10/1985 | Groeneveld et al. | 100/98 R |
| 4,583,697 | A | | 4/1986 | Bichot et al. | 242/55.1 |
| 4,602,472 | A | | 7/1986 | Ampolini et al. | 53/438 |
| 4,608,807 | A | | 9/1986 | Skripalle | 53/399 |
| 4,765,554 | A | | 8/1988 | Tuffal et al. | 242/55.1 |
| 4,896,476 | A | | 1/1990 | Harris | 53/118 |

(Continued)

FOREIGN PATENT DOCUMENTS

| | | |
|---|---|---|
| DE | 296 04 901 | 6/1996 |

(Continued)

OTHER PUBLICATIONS

Kaibel & Sieber, Roll-up and Packing Machine for Rolls, retrieved online, retrieved on Jan. 20, 1997 retrieved from.

*Primary Examiner*—John Q. Nguyen
(74) *Attorney, Agent, or Firm*—Brian S. Steinberger; Law Offices of Brian S. Steinberger, P.A.

(57) ABSTRACT

The invention generally relates to the packaging of compressible material into compressed rolls and in particular, to a method and apparatus for packaging fibreglass insulation and similarly compressible materials, into highly compressed, consistently uniform, rolls. Such rolls are easier and less expensive to handle, store and ship. The main design of the invention is for a roll-up machine which has three continuous belts defining a circular cavity and establishing generally circumferential contact with the compressible material so that the compressible material is under compressive pressure as it is being rolled; means for putting the three continuous belts under tension; means for driving the three continuous belts; and means for feeding the compressible material into the circular cavity.

27 Claims, 33 Drawing Sheets

U.S. PATENT DOCUMENTS

| | | | | | |
|---|---|---|---|---|---|
| 4,928,898 | A | | 5/1990 | Audren et al. | 242/55.1 |
| 5,305,963 | A | | 4/1994 | Harvey, III et al. | 242/55.1 |
| 5,417,038 | A | | 5/1995 | Babel | 53/447 |
| 5,425,512 | A | | 6/1995 | Bichot et al. | 242/541.3 |
| 5,832,696 | A | | 11/1998 | Nagy et al. | 53/430 |
| 6,109,560 | A | * | 8/2000 | Siegel | 242/541.2 |
| 6,123,284 | A | | 9/2000 | Bichot et al. | 242/541.2 |
| 6,286,419 | B1 | | 9/2001 | Wallace | 100/86 |
| 6,321,507 | B1 | | 11/2001 | Copeland et al. | 53/118 |
| 2002/0066376 | A1 | | 6/2002 | Wallace | 100/40 |

FOREIGN PATENT DOCUMENTS

| | | |
|---|---|---|
| EP | 0 551 228 | 1/1993 |
| EP | 0 679 579 | 3/1995 |
| EP | 0 734 985 | 3/1996 |
| EP | 0 941 952 | 3/1998 |
| EP | 0 949 172 | 4/1998 |
| FR | 2 685 904 | 1/1992 |
| FR | 2 731 687 | 3/1995 |
| WO | WO 94/12417 | 6/1994 |

* cited by examiner

BELT ROLL-UP MACHINE COMPARISON TABLE

STATIONARY MACHINE, FIXED POSITION ENTRY ROLLERS, FOUR TRAVELLING ROLLERS, ROLLER STARTING CONFIGURATION: REGULAR HEXAGON WITH SIDE LENGTH a, ROLLER TRAVEL ANGLE ALPHA, ROLLER TRAVEL DISTANCE l1 AND l2

ROLLER DIAMETER d = 2r = 4.5 INCH
INITIAL SPACING BETWEEN ROLLERS s = 1 INCH
INITIAL HEXAGON SIDE LENGTH a = 5.5INCH

PRODUCT ROLL FINAL DIAMETER D = 24INCH

| ROLLER TRAVEL ANGLE ALPHA [DEG] | ROLLER 1 TRAVEL DISTANCE l1 [INCH] | ROLLER 2 TRAVEL DISTANCE l2 [INCH] | BELT SEGMENT 1 COVERAGE ANGLE [DEG] | BELT SEGMENT 2 COVERAGE ANGLE [DEG] |
|---|---|---|---|---|
| 15 | 19.473 | 17.324 | 121 | 61 |
| 20 | 18.350 | 16.892 | 113 | 74 |
| 25 | 17.175 | 16.438 | 105 | 86 |
| 30 | 15.968 | 15.968 | 98 | 98 |
| 35 | 14.749 | 15.487 | 90 | 109 |
| 40 | 13.540 | 15.001 | 84 | 121 |
| 45 | 12.363 | 14.514 | 77 | 132 |

FIG. 28

ROLL-UP MACHINE AND METHOD

The invention generally relates to the packaging of compressible material into compressed rolls and in particular, to a method and apparatus for packaging fibreglass insulation and similarly compressible materials, into highly compressed, consistently uniform, rolls. Such rolls are easier and less expensive to handle, store and ship.

BACKGROUND OF THE INVENTION

In many industries, large quantities of compressible materials must be stored and transported around. Compressing these materials into smaller volumes often results in significant cost savings. Fibreglass thermal/acoustical insulation (glass wool), mineral wool products (rock wool, slag wool), fabrics or mats of organic or inorganic materials, and compressible foam materials such as polyurethane foam blankets are just a few examples of materials which are more efficiently handled in a compressed form.

The need for substantially reducing the volume of light density thermal/acoustical fibreglass insulation products for shipping and storing is clear. Common fibreglass insulation products such as types R-11, R-13 and R-19, have densities ranging from 0.52 to 0.60-pcf (pounds per cubic foot). Because the density of the glasses used to make this insulation lies roughly in the range of 2,600 to 2,800 kg/m3, it can be determined that the actual volume occupied by the glass is often less than 0.5% of the total product volume. Handling such a bulky product without any compression is clearly impractical, particularly from an economic point of view. It is therefore common practice to substantially reduce the product volume by roll winding and other packaging processes. However, compression cannot be allowed to damage the product to the point that it does not recover its nominal thickness and performance levels after unpacking. Lack of thickness and performance recovery directly translate into some loss in product utility and value, defeating the purpose of the exercise.

Compression of fibreglass products is typically performed in either a one-stage process or a two-stage process. The leading one-stage technique is winding of the compressible material into a compressed roll. In some processes a second stage is performed to compress the already rolled material, either by applying direct mechanical force or a vacuum. During the final stage of bundling rolls together, typically in units of four, some additional pressure may also be exerted, for example, using a stretch wrap.

Over the years a large variety of roll-up machine designs have been developed, but in principle, they can be grouped into just a few general categories. Of particular interest are the following:

1. mandrel-based designs;
2. single-belt, "free-loop" designs;
3. triangular cavity designs;
4. rigid arcuate jaw designs; and
5. circular cavity designs.

An exemplary mandrel-based design is presented in FIG. 1. Mandrel-based designs employ a mandrel 110 against which the leading edge of the insulation blanket 112 is held for rolling-up. The mandrel 110 is then rotated and the compressible material rolled up on the mandrel 110, meanwhile being compressed using some system of continuous belts (in this case, first by continuous belt 114, and then by belt 116). In the case of FIG. 1, the position of rollers 118 and 120 are adjusted as the roll grows, as are rollers 122 and 124.

These machines typically overcompress the leading portion of the blanket, causing some loss in thermal insulation value for this portion due to lack of product thickness recovery after unpacking. U.S. Pat. No. 5,832,696 discloses an exemplary version of such a mandrel-type roll-up machine.

A mandrel-type roll-up machine with automatic, rather than manual, tucking and starting of the compressible sheet material on a mandrel is disclosed in U.S. Pat. No. 6,286,419. While this design operates more quickly and efficiently than that of the '696 patent, it still suffers from the deficiency of over-compressing the leading edge of the material being rolled. Typically, roll-up machines of this type are used for rolling relatively thin compressible sheet material ranging in thickness from 0.5 inch to 2 inches. It is desirable that roll-up machines be able to handle much thicker materials, for example, in the range of about 1.5-inches up to 9-inches.

Another class of roll-up machines uses a continuous, single-belt loop in a "free-loop" configuration. An exemplary "free-loop" design is shown in FIG. 2. The compressible material 112 is transported by a belt conveyor, and enters a cavity or loop 132 formed by a single continuous belt 134. The single continuous belt 134 is held at the entry point for the compressible material by a combination of a fixed roller 136 and a series of rollers 138 or a properly shaped belt conveyor, which also serves to support the rolled product weight. This is referred to as a "free-loop" design because there are no guides which cause the free-loop to take on any particular shape; hence, the roll will take on a generally circular or oval cross-section.

Over the years, numerous improvements were made to this single-belt concept, details of which can be found in the following U.S. Pat. Nos. 3,133,386; 3,911,641; 3,964,235; 4,114,530; 4,163,353; 4,164,177; 4,602,471; 4,653,397; 4,896,476 and 6,321,507. While roll-up machines of the single-belt "free-loop" design offer some advantages over mandrel-based designs, they still suffer from several major operational deficiencies.

As explained in U.S. Pat. No. 6,321,507, the conventional, single-belt "free-loop" design, with a fixed belt width, has a limited ability to efficiently package compressible materials of various widths. Attempts to operate this roll-up machine with less than a full belt width of compressible material results in what is referred to as "telescoping" or "coning", that is, a relative axial shift or displacement of subsequent concentric layers of the rolled strips of material with respect to each other. Telescoping complicates the wrapping of the roll product with a sheet material (such as a plastic film) as overall, the roll is now longer than it should be. As well, the ends of the roll are conical instead of flat, making stacking in a warehouse or storage facility difficult.

To avoid telescoping during the roll forming process one has to operate with the full belt width filled with insulation. If a narrower width is desired, then a full belt width must still be used in the single belt machine. A full width of insulation material coming out of the curing oven is longitudinally slit, but the full width is rolled up. After rolling, the surplus material can be removed from the rest of the roll. While the surplus material may be recycled as loose fill insulation or admix, this process is both an inconvenience and economically inefficient.

U.S. Pat. No. 6,321,507 addresses the telescoping issue by using at least two endless belts, partially overlapping in the loop forming area as well as the belt take-up area. With this design, the overall belt width can be adjusted by changing the degree to which the two belts overlap, to exactly match the product width needed. This is a complicated approach to the telescoping problem, and of course, does nothing to address other problems with the "free-loop" designs. These other problems include the following:

1. dealing with tremendous slack on the continuous belt when the rolled material is released (i.e. slack is the difference between the circular segment of belt encircling the roll, and the corresponding straight-line length of belt between the rollers, after the finished roll has been ejected). This slack often causes the belt to leave its guides; and
2. lack of control over the actual shape and quality of the roll. As the material typically takes on an irregular and inconsistent cross-section, handling and storage are difficult and inefficient. As well, the irregular shape will result in uneven compression which may damage the compressible material.

Another major class of roll-up machines employs a system of horizontal 150 and inclined belt 152 conveyors, and moveable forming rollers 154 to define a generally "triangular" roll forming space 156. An exemplary triangular cavity design is presented in FIG. 3.

An early design in this class of roll-up machines, based on a combined use of two belt conveyors and a forming or compression roller forming a triangular geometry is disclosed in U.S. Pat. No. 3,991,538. Further improvements are disclosed in U.S. Pat. Nos. 4,583,697; 4,608,807; 4,765,554; 4,928,898; 5,305,963; and 6,109,560 and in patents DE 296 04 901 U1; EP 0 941 952 A1 and EP 0 949 172 A1. These designs have various arrangements of driving and idle rollers, sensing devices (pressure and roll diameter, for example), position control devices and control algorithmsAll roll-up machines based on a triangular geometry offer, in principle, just a three-point contact between the product being rolled and the rigid, roll-shaping members over the whole roll circumference. Any compressive pressure that is applied, can only be exerted at three distinct contact points, or to be more precise, three contact zones or areas rather than points, since the material being handled is compressible and deforms under load. This does not change the basic fact, however, that the compressive force can only be applied to a limited area, instead of being distributed more or less uniformly over the whole roll circumference, as in the single-belt, "free-loop" roll-up machines. If one squeezes too much, in an attempt to end up with a tight roll with a high overall compression ratio, fibre breakage and/or binder bond loss is likely to occur in the compression zones, resulting in poor thickness recovery after unrolling.

As the roll diameter increases, so does the distance between the three pressure points along the roll circumference, and the travel time between subsequent pressure points. After leaving a given pressure point, the compressed material is no longer under pressure and will expand, at least to some degree, before reaching the next compression point, where it is compressed again. This cycle of compression and de-compression is repeated many times as the roll is formed, the repetitive loading damaging fibres and causing binder fatigue.

Triangular cavity roll-up machines are capable of forming rather loosely wound rolls of fibrous insulation material with an overall compression ratio of about 3.5:1, and therefore a second compression step is usually performed. This second compression step typically employs vacuum compression or mechanical pressure, and may result in a final compression ratio between 6:1 and 8:1. It is not that convenient or economical to have this two-stage operation; quite often the process is not fully automatic and requires additional manpower compared to one-step processes. This second-stage compression also causes further damage to the material because the material is in a fixed roll when the second compression is applied. It is therefore desirable to obtain similar compression ratios, in a single-stage operation.

The next group of roll-up machines of interest are those which employ rigid arcuate jaws. Two of such roll-up machines are described in U.S. Pat. Nos. 3,808,771 and 3,964,232. An exemplary schematic of such a design is presented in FIG. 4, employing two such arcuate jaws 160, 162. In both cases, open centre, loose rolls are formed, which yield about a 2:1 compression ratio.

The intention with the '771 and '232 designs is only to obtain a small degree of compression with the rolling stage (2:1), obtaining the balance of the desired compression in a second, vertical compression stage to obtain an overall compression of about 8:1. Limited compression can be obtained in the rolling stage because the arcuate jaws 160, 162 have a rigid shape and the shape of the cavity they define 164 does not stay circular as the roll grows.

After forming loose, oval-shaped rolls in the first stage, a number of rolls are stacked in a tall compression chamber, and are then compressed further by mechanical means.

This two-stage technique is slow, requires two machines, requires manual labour between the two stages, and damages the compressed material because of the tight compressed turns in the material, formed during the second stage.

Recently, "circular cavity" roll-up machines have begun to appear, which overcome various problems with the earlier designs, using two endless belts to define a generally circular roll-up cavity. An exemplary schematic diagram is presented in FIG. 5.

U.S. Pat. No. 5,425,512 for example, discloses two designs where separate endless belt systems 170, 172 are combined to form two arcuate belt lengths, almost entirely enveloping the roll of the compressible material 112 during the roll forming process.

The cavity 174 in which the winding of the compressed fibrous material takes place is defined by five rollers and two belt conveyors, one roller 176 being part of the bottom conveyor 178, and two downstream rollers 180, 182 which are not fixed in place, but moving away along rectilinear paths; their movement or travel being computer controlled. Two other rollers 184 and 186 are generally fixed in place. A variant of this circular cavity design in the '512 patent employs a complicated two carousel system to reduce the non-productive time between subsequent winding operations, the start of a new roll winding, taking place immediately after the ejection of an earlier roll of product. Each carousel has a set of three rollers mounted on 120-degree spaced arms, and only one roller at a time is used to make a given roll of product. A rather involved algorithm is required to control all the aspects of the roll winding and roll ejection process.

There are a number of major problems with two-belt roll-up machines in general. For example:

1. with a two-belt design it is quite difficult to start the formation of a new roll. If the two belts are held tight at the beginning of the process (which is necessary, to an extent, to compress the material being rolled), then the two belts do not define a cavity which aids in the rolling up of the material being compressed. Rather than having a circular or triangular cavity, the cavity is defined by two belts which are parallel to one another and travelling in opposite directions. Thus, the two-belt roll-up machine cannot start rolling the compressible material in a neat and uniform way. Typically, some extra mechanical means (apart from the two belts themselves), is employed to assist the starting of the roll.

One could start up the roll without any external means as shown in FIGS. 29A through 29C, but one would have to rely entirely on some taper added to the initial belt geometry in the roll forming zone, combined with the appropriate compressed mat thickness with respect to the entry gap height between the forming rollers of each belt segment. This concept could be used to start the roll satisfactorily but only at the expense of substantially enlarging the entry gap between the forming rollers.

Alternatively, FIGS. 30 through 33 present diagrams of a design where the process of the roll startup is mechanically aided by an external mechanical system.

Additional mechanical complication, extra cost, more maintenance, high dynamics of top belt configuration change and belt tracking are some of the issues which must be dealt with if one uses this design; while the two-belt designs have to deal with less slack than the "free loop" designs, the amount of slack on the continuous belts when the rolled material is released, is still a very significant problem. This slack can cause the belts to leave their guides during the operational cycle, so many designs used take up cylinders to absorb this slack. The more slack that has to be absorbed, the longer the travel of the take up cylinder system.

A more detailed discussion of slack is described hereinafter;

2. the two-belt designs known in the art also require a very quick and drastic change in the positions of the rollers for a speedy ejection of the roll of product; and
3. also similar to the "free loop" systems, two belt roll up machines do not maintain cross-section symmetry very well. This often results in geometrical distortion of the completed roll, commonly known as coning or telescoping.

There is therefore a need for a high-compression roll-up machine and method of rolling that results in consistent and uniformly shaped rolls, with minium damage to the material being rolled. This design must be mechanically straightforward and reliable, ideally using a simple control algorithm and control system.

SUMMARY OF THE INVENTION

It is therefore an object of the invention to provide a novel method and apparatus for rolling compressible materials which offers some operational advantage over the prior art.

One aspect of the invention is broadly defined as a roll-up machine for rolling up a compressible material comprising three continuous belts defining a circular cavity and establishing generally circumferential contact with said compressible material so that said compressible material is under compressive pressure as it is being rolled; means for putting said three continuous belts under tension; means for driving said three continuous belts; and means for feeding said compressible material into said circular cavity.

Another aspect of the invention is defined as a method of operation for a roll-up machine for rolling up a compressible material, the roll-up machine including three continuous belts defining a circular cavity, the method comprising the steps of: putting the three continuous belts under tension; driving the three continuous belts; and feeding the compressible material into the circular cavity, establishing generally circumferential contact with the compressible material so that the compressible material is under compressive pressure as it is being rolled.

Further objects and advantages of this invention will be apparent from the following detailed description of a presently preferred embodiment which is illustrated schematically in the accompanying drawings.

BRIEF DESCRIPTION OF THE DRAWINGS

These and other features of the invention will become more apparent from the following description in which reference is made to the appended drawings in which:

FIG. 28 presents a summary of the control parameters for implementations of the invention using forming roller linear track angles in increments of 5-degrees from 15-degrees to 45-degrees;

DESCRIPTION OF THE INVENTION

Figure 1:
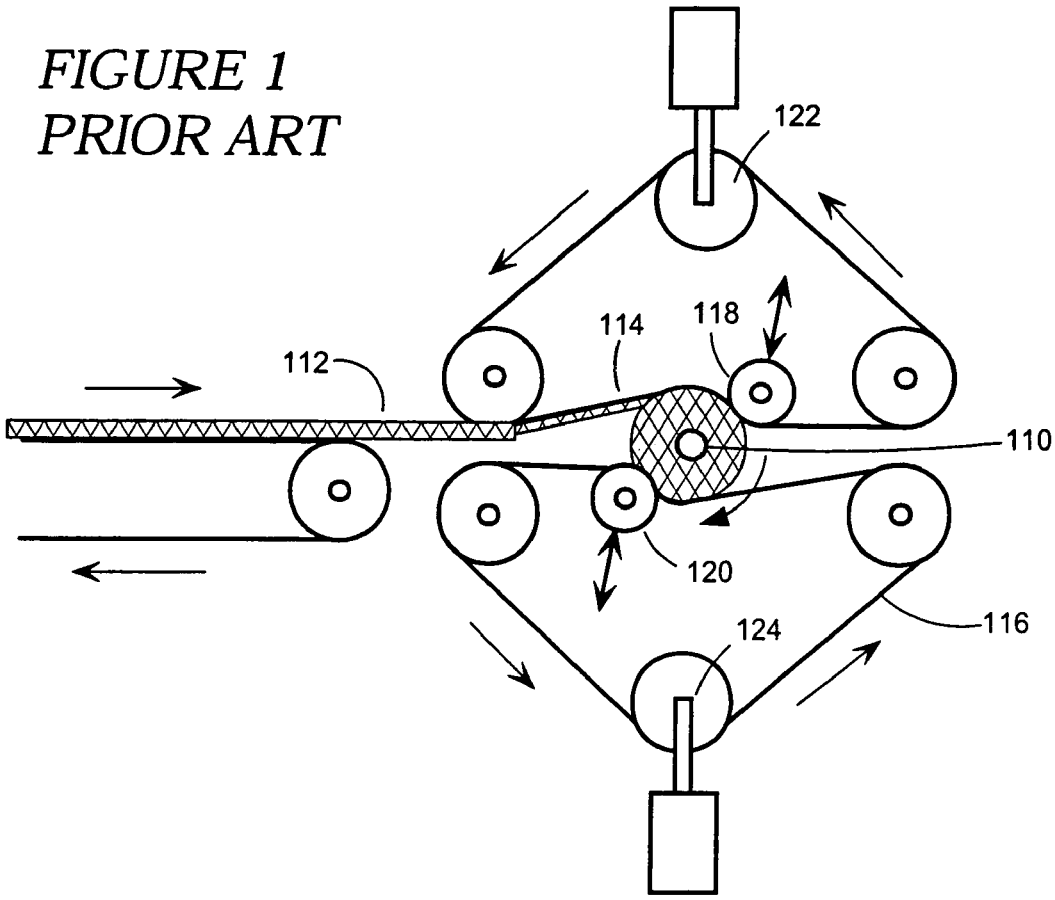
FIGURE 1 PRIOR ART
FIG. 1 presents a side elevation view of an exemplary mandrel-based roll-up machine as known in the art.
Figure 2:
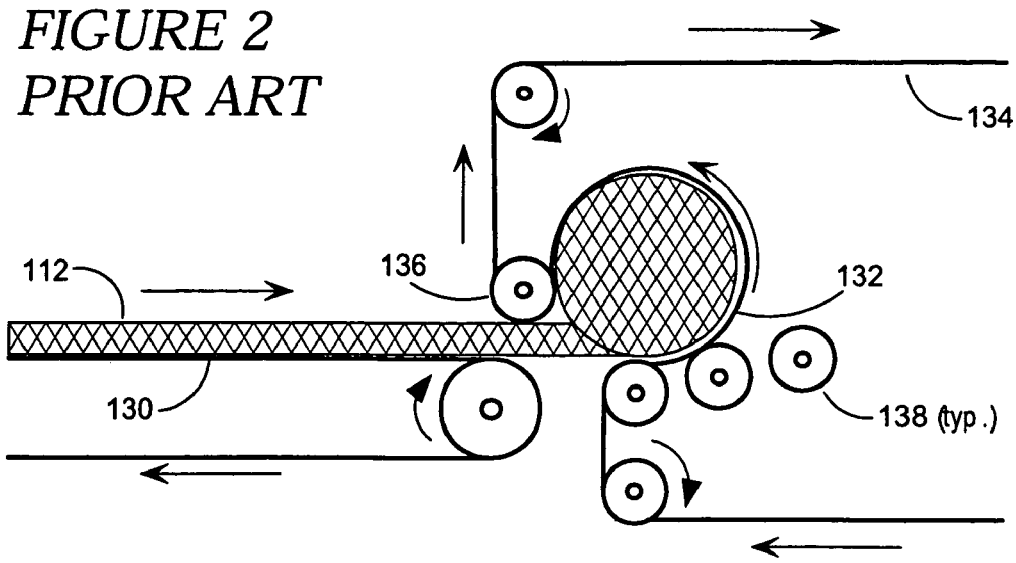
FIGURE 2 PRIOR ART
FIG. 2 presents a side elevation view of an exemplary single-belt, "free-loop" roll-up machine as known in the art.
Figure 3:
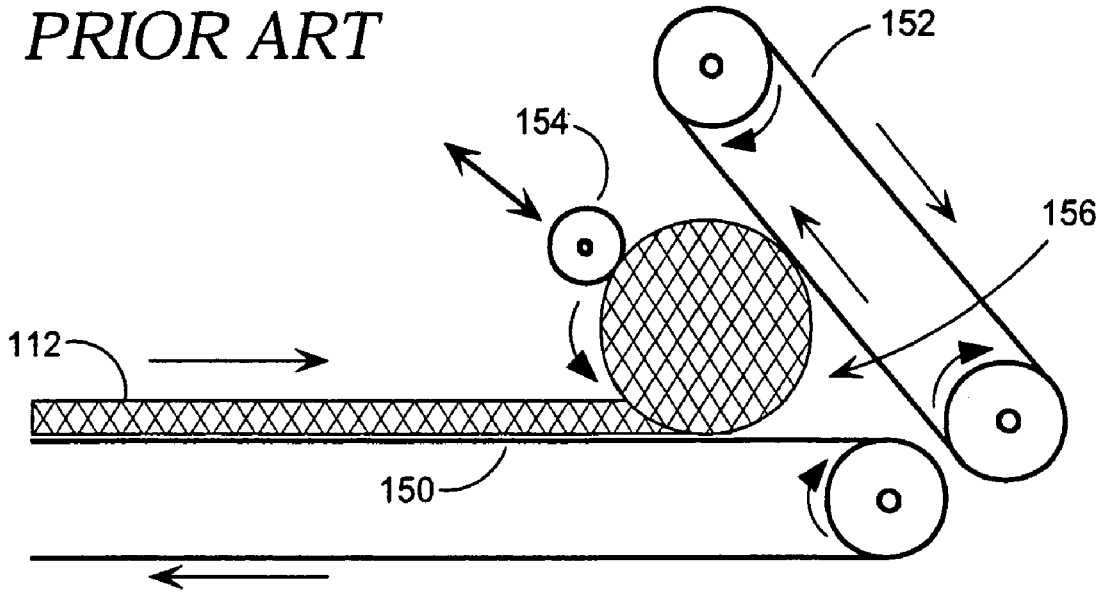
FIGURE 3 PRIOR ART
FIG. 3 presents a side elevation view of an exemplary triangle cavity roll-up machine as known in the art.
Figure 4:
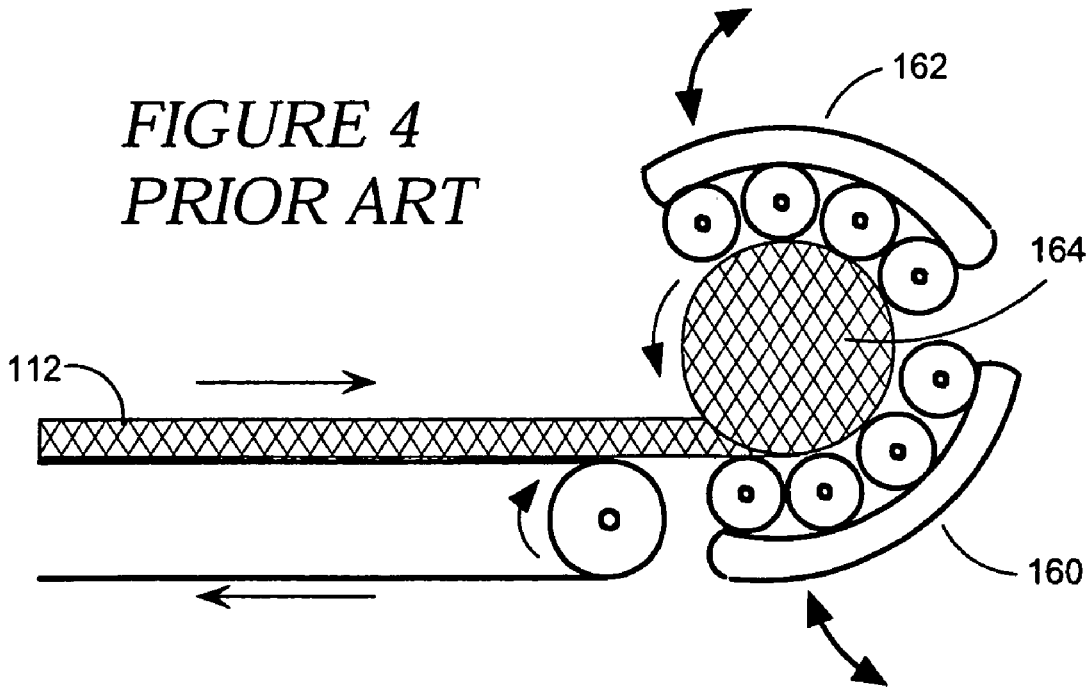
FIGURE 4 PRIOR ART
FIG. 4 presents a side elevation view of an exemplary rigid-arcuate jaw roll-up machine as known in the art.
Figure 5:
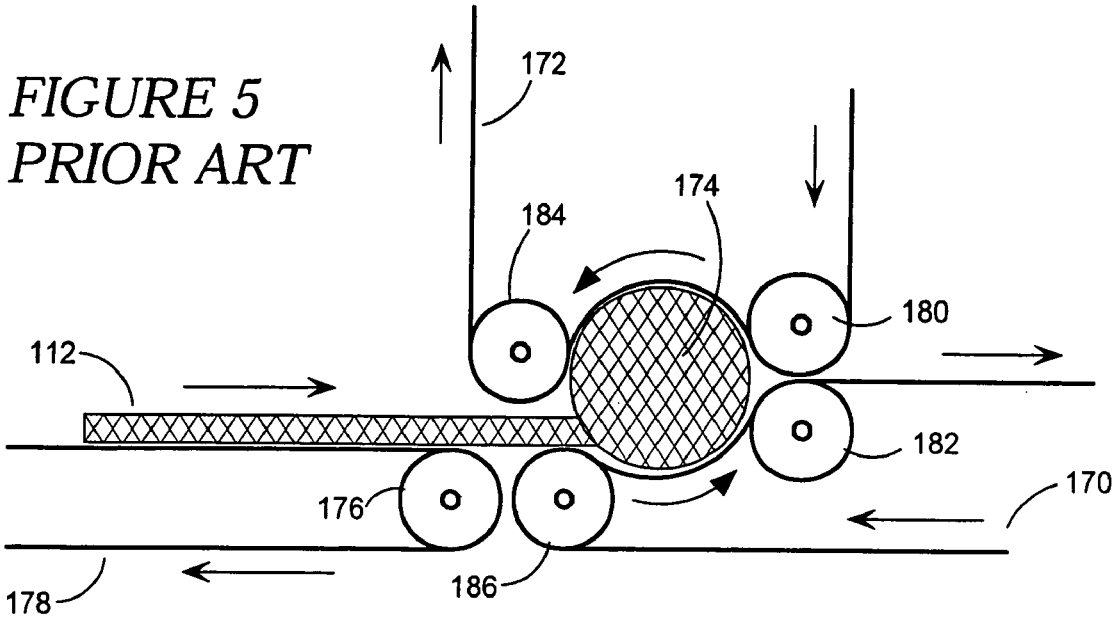
FIGURE 5 PRIOR ART
FIG. 5 presents a side elevation view of an exemplary circular cavity roll-up machine as known in the art.
Figure 6:
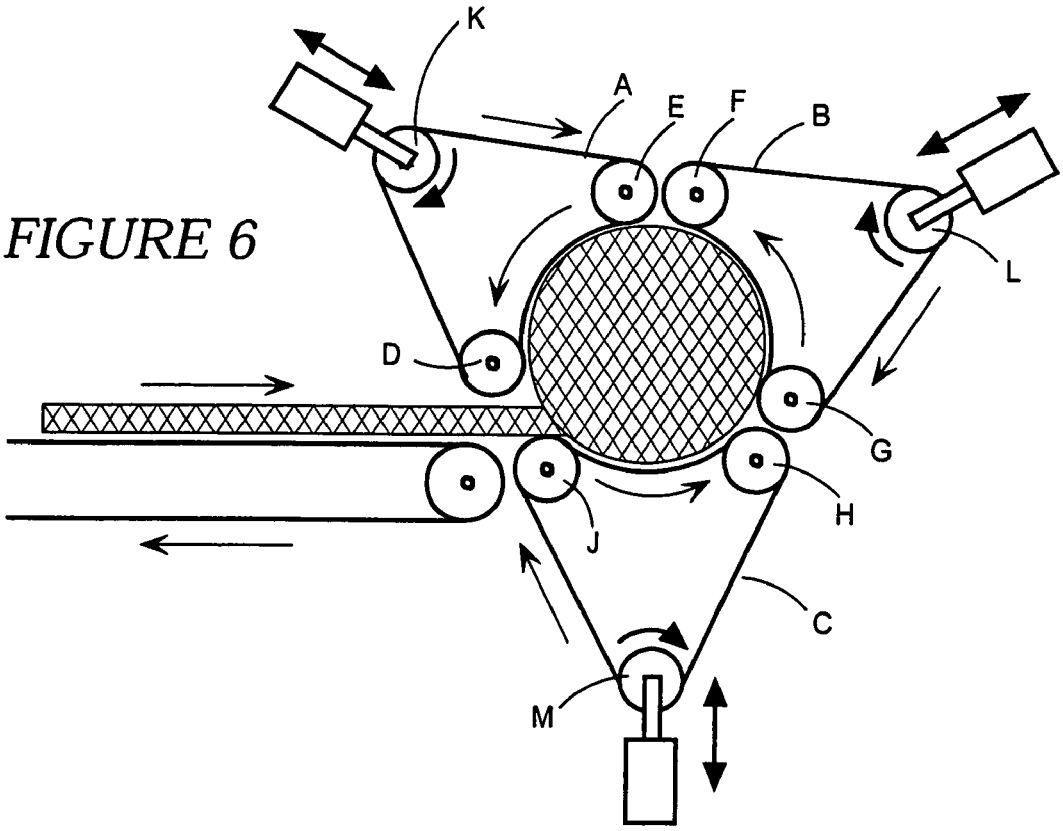
FIG. 6 presents a side elevation view of an improved roll-up machine in a broad embodiment of the invention.

A system which addresses the objects outlined above, is presented schematically in FIG. 6.

The roll-up machine of the invention is based on three continuous belts A, B, C which are arranged to form a circular cavity. This circular cavity will establish generally circumferential contact with the compressible material, so that, apart from a very small entry point, it is continuously under compressive pressure as it is being rolled.

The three continuous belts A, B, C could be held in a circular cavity in a number of ways, but typically, the circular cavity will be defined by the positions of six forming rollers D, E, F, G, H, J with some mechanism being used to coordinate the positions of these six forming rollers. The position of the six forming rollers could, for example, be controlled by hydraulic cylinders or linear actuators such as mechanical screws. As the six forming rollers will be displaced in a coordinated manner, individual actuators are not necessarily required; it is possible to position the six forming rollers in pairs or even all six at a time, using a single drive mechanism and mechanical linkages.

It will be clear from the detailed description which follows that one of the major considerations in designing the roller and belt system is how the finished rolls are to be ejected from the machine. If all of the forming rollers are linked together, rolls will typically be ejected by pushing them sideways out of the roll up cavity. It is generally preferable to eject rolls by moving one or more of the belt systems out of the way, so that the finished roll can be ejected in a direction which is "in-line" with the rest of the process.

This system also requires some mechanism for putting the continuous belts A, B, C under tension, and some mechanism for driving the three continuous belts. Both of these operations can be effected in many ways, which would be known to one skilled in the art. Tension, for example, may be placed on the continuous belts by the use of tensioning rollers K, L, M as shown in FIG. 6, and some mechanism for displacing the tensioning rollers, such as hydraulic or pneumatic rams, or mechanical screws. As will be explained in greater detail hereinafter, all three of the continuous belts A, B, C will typically be placed under the same degree of tension so it is not necessary to design three completely independent tensioning systems. A single control system and algorithm, for example, could be shared by all three of the continuous belt systems. Sharing elements of the tension system results in a less costly and simpler design to fabricate and maintain.

The three continuous belts A, B, C may be driven using any of the forming rollers D, E, F, G, H, J or tensioning rollers K, L, M shown in FIG. 6, for example, coupling them to suitable AC or DC motors or gearmotors. These motors may operate at fixed speeds, have their speeds manually controlled, or be automatically controlled. As well, all three belts may be driven by a single drive mechanism, or be driven separately. Other driving arrangements would be clear to one skilled in the art.

Most industrial applications will probably drive each of the three belt systems separately, using AC induction gearmotors powered by variable speed drives (VSDs) or variable frequency drives (VFDs). These VSDs or VFDs will typically be controlled by a programmable logic controller (PLC) or the like.

Finally, this machine requires some mechanism for feeding compressible material into the circular cavity arrangement. As shown in FIG. 6, this may consist simply of a horizontal conveyor, but any apparatus may be used which is operable to feed either continuous lengths of compressible materials, or short "batts" of compressible materials into the roll-up machine.

This design results in very high levels of compression without damaging the compressible material as many other designs do (particular two-stage processes). Compression ratios greater than 10:1 have been obtained using the design of the invention in a single-stage operation, causing minimal fibre structure (matrix) damage and resulting in full recovery of the product's original thickness and other properties. In contrast, it was found that earlier generation roll-up machines were limited to about a 6:1 compression ratio for a single-stage operation, and up to 8:1 compression for a two-stage process, when considering a 10 kg/m$^3$ (0.6 pcf), 300 mm (12") thick fibrous product, and demanding good thickness recovery.

This design also results in much more uniform rolls, as the compressible material is being guided by a larger number of rigid forming rollers than any of the designs in the prior art.

While the three-belt design of the invention may seem similar to other circular cavity designs, it has a number of unexpected and distinct advantages over two-belt designs.

To begin with, most two-belt designs require a separate, external system for starting the roll, as described in the Background to the Invention above. This is because two-belt designs typically do not provide a cavity which is convenient to begin the rolling of the material (such as a circular or triangular cavity). The three belt design inherently has a natural geometry which starts the roll without complication or damage, or an external feed system. This results in higher quality and more uniform rolls, without the cost and maintenance of an external feed system.

One might expect the three-belt design to result in added complexity and cost when compared to two-belt designs. However, the use of three belts results in the rolled material becoming more uniform in cross section. Thus, while two-belt systems have to deal with unequal displacement and tension in the belts, the three-belt system does not. All three of the belt systems can be designed and operated to the same specifications, resulting in simpler and less costly design—all three belts can be the same length and use the same tensioning and driving components. A simple control algorithm can be used to implement the invention, because it is not necessary to control each belt separately as in the case of the two-belt systems.

Because the three-belt system results in an additional gap that the compressible material must cross in being rolled, one might expect the three-belt system to be less reliable than the two-belt system. However, the spacing of the gaps is easily controlled and can be kept to a minimum. The additional gap was found not to effect reliability of the invention at all.

The three-belt design was found to actually be more reliable than two-belt designs because less slack results when a roll is ejected. This slack often causes the belts to leave their guides and/or rollers, forcing the machine to be shut down. It also requires take-up systems with longer travel; again, being more expensive and less reliable than the short take-up systems used with the invention. The three-belt designs reduce the slack by a great deal, so they are far more reliable than two-belt designs in this respect.

The more slack that the system has to deal with on roll ejection, the more likely it is that the belts will leave their tracks or guides. Given a finished roll of radius r and circumference $2\pi r$, a "free-loop" design has to deal with approximately $2\pi r$ of belt slack immediately after a finished roll is ejected. In two-belt designs, each belt system will have to deal with the following (assuming that each belt has to deal with the optimal condition of half of the slack):

$$\begin{aligned} SLACK_{TWO-BELT} &= \frac{\text{Circumference}}{2} - \text{Shortest Belt Length} \\ &= 2\pi r/2 - 2r \\ &= r(\pi - 2) \\ &= r(1.14159) \end{aligned}$$

"Shortest Belt Length" in the equation above refers to the shortest length of belt between two forming rollers that results after all of the slack is absorbed. In the case of a two-belt design, the "Shortest Belt Length" is approximately equal to the diameter of the finished roll; i.e. 2r.

In the case of the three belt system, the "Shortest Belt Length" is equal to the span of an isoceles triangle having two sides of length r with an angle of 120 degrees between them. This is equal to $3r/\sqrt{3}$ which can be reduced to $r\sqrt{3}$. Thus:

$$\begin{aligned} SLACK_{THREE-BELTS} &= \frac{\text{Circumference}}{3} - \text{Shortest Belt Length} \\ &= 2\pi r/3 - r\sqrt{3} \\ &= r(2\pi/3 - \sqrt{3}) \\ &= r(0.36234) \end{aligned}$$

This is less than one-third of the slack that must be handled in two-belt systems, and only 6% of the slack that a free-loop design must deal with. In the preferred embodiments described hereinafter, mechanisms are shown for reducing this slack even more.

In the case of a roll with a finished diameter of 24", or a radius of 12", the slack that must be absorbed is as follows:

| | units | "free-loop" | two-belt | three-belt |
|---|---|---|---|---|
| formula for absolute slack | — | $2\pi r$ | $r(\pi - 2)$ | $r(2\pi/3 - \sqrt{3})$ |
| absolute slack | inches | 75.4 | 13.7 | 4.3 |
| slack as a percentage of belt length | % | 100 | 36 | 17 |

The reduced slack of the three-belt design results in better tracking, and take-up systems with much shorter travel. Among other things, this results in greater reliability of operation, and faster operation.

The system of invention also overcomes many of the problems that non-circular cavity designs have. For example:

- it provides much better compression than mandrel-based designs, without the complexity and damage to the compressible material that such designs suffer from;
- it does not suffer from the telescoping deficiency typical of "free-loop" and two-belt designs. Because the shape of the circular cavity is maintained by the six forming rollers, the cavity does not become geometrically deformed. It is this deformation which causes telescoping in the compressible material.
- A machine built using the invention can roll-up varying widths of material, while the "free-loop" designs cannot. The invention can also be used efficiently with any length of material, including individual batts;
- the compressible material is compressed by a uniformly distributed pressure, unlike the triangular cavity designs which essentially apply pressure at three points. Hence, with the design of the invention, the compressible material is kept under compression virtually over the whole roll circumference, so compression/decompression cycling is practically eliminated. As explained above, the repeated compression and de-compression action of triangular cavity designs causes damage to the compressible material and results in reduced thickness recovery and reduced product performance;
- the nature of the belt geometry change during the entire process, and particularly during roll ejection, is much slower paced than most of the designs described in the Background herein above. In the "free-loop" and two-belt designs, for example, the belt geometries change much more quickly both as the roll diameter grows, and on ejection of a roll; and the invention results in much higher throughput and much shorter non-productive times because no manual operations are needed as in the case of two-stage processes.

Thus, the invention provides a simple, low cost design that results in high levels of compression with minimal damage to the compressible material. The preferred embodiments of the invention have many additional advantages, which are described hereinafter.

DETAILED DESCRIPTION OF PREFERRED EMBODIMENTS OF THE INVENTION

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Option 1—Basic Design

This embodiment is based on the following design parameters:

1. fixed feed point;
2. fully symmetrical forming roller arrangement (120-degrees);
3. all six forming rollers moving outwards; and
4. the roll-up machine travelling back in synchronization with the movement of the forming rollers.

This embodiment of the invention is presented in FIGS. 7 through 15. It is designed to receive compressible fibreglass insulation, already cut to length, laid flat on a sufficiently long transfer conveyor, accelerated from the line speed to the winding speed, and conveniently separated in the downstream direction.

The uncompressed strip of glass fibre insulation material, before reaching the roll-up winding space, where the roll of product is actually formed, first enters a stationary pre-compression system 1, shown only partially in FIGS. 7 to 12. This design is "stationary"; unlike some earlier roll-up designs, such as those of U.S. Pat. Nos. 6,109,560 and 5,305,963, in that the pre-compression system 1 is not travelling either in the downstream or upstream direction. This is a definite advantage as no dedicated control system is needed for executing this task (a control system is, of course, required for the rest of the machine).

The stationary pre-compression system 1 consists of two belt conveyors 1*a* and 1*b* gently converging towards the mouth of the circular cavity of the roll-up machine. The bottom conveyor 1*a* is fixed, horizontal, and arranged to be the final link in the long transfer conveyors chain. Above it is an inclined belt conveyor 1*b*, which can be appropriately adjusted to meet the compression ratio requirements for a given product. This adjustment can optionally be done by moving the inclined conveyor 1*b* up and down, or by changing its inclination angle. It is also possible to have both adjustment mechanisms combined together. Suitable swivel or adjustable mounts would be known to one skilled in the art.

The exit gap height of the pre-compression system 1 is set for each product as a function of product nominal thickness and the average compression ratio required. Since product actual thickness usually differs (intentionally) from its nominal thickness, a suitable correction factor should also be taken into account during the process of the exit gap thickness setting.

If the exit gap is height adjustable, the forming roller 5*a* should also be height adjustable, so the entry gap can be varied to meet changes in the compressed material thickness. The forming roller 5*a* position adjustment does not necessarily have to be made in the strictly vertical direction; an inclined path is also possible, and may even be preferred in some applications.

Compressed material thickness is equal to the exit gap thickness. Precautions are taken to keep the material compressed all the time, performing the pre-compression and rolling in the highly compressed state, without any decompression or expansion occurring during the process. The typical control algorithm for the roll winding process is based on the fixed compressed material thickness, all the product compression having been done right during the pre-compression stage. From the compression point of view, the winding stage is an idle one, and works only to retain this compression. By a slight modification of the control algorithm for the winding process it is also possible to run a winding operation in an active mode, where some extra compression can be added during the winding stage itself. Either way, the material being rolled is compressed in what is generally regarded as a single stage, continuous process.

To avoid damaging the compressible material during the pre-compression stage, given the high compression ratio (something like 10:1), it is preferred to perform this task rather gently, using a small inclination angle, longer inclined conveyor length and longer compression time. Other means for easing the glass fibre insulation product into compression before winding it into the roll include the following:

1. matching the horizontal component of the inclined conveyor velocity with the horizontal conveyor velocity; and
2. improving the air removal process during the product pre-compression stage, for example, by use of perforated belts and underneath suction boxes.

Figure 11:
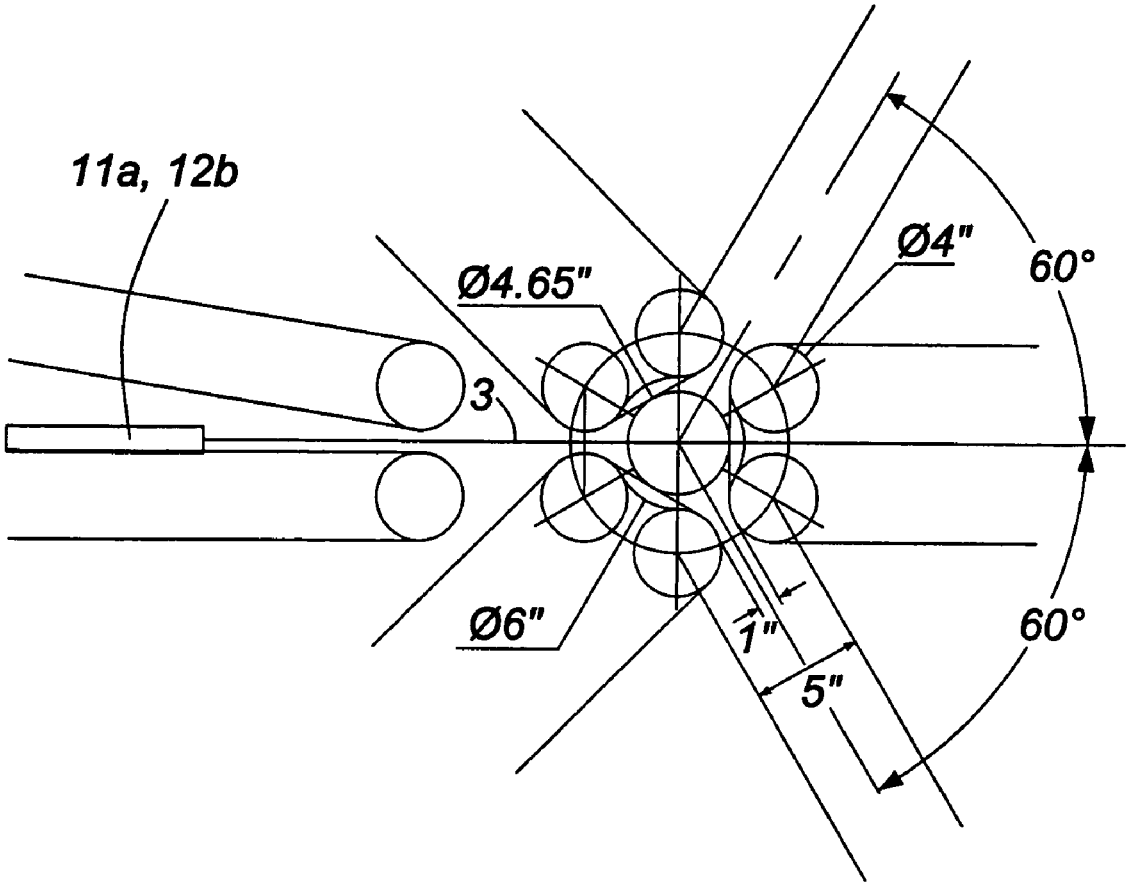
FIG. 11 presents a side elevation view of a first embodiment of the invention, in a starting position, showing exemplary calculations for the starting size of the roll.

After leaving the pre-compression system 1, the compressed material is fed into the circular cavity 2 of the roll-up machine. To keep the material in its highly compressed state right to the point of rolling it up into the rolled product, it is desirable to keep the distance between the pre-compression stage exit plane and the winding space entry plane to a minimum. It is also desirable to avoid any free gap to allow product expansion in the up-down direction. A toe plate 3 (guide plate 3), shown in FIG. 11, is placed right behind the inclined conveyor, and extends into the entry zone of the roll winding space. The toe plate 3 serves two purposes: firstly, it shields the compressed material from touching the upper belt of the winding space entry zone, running in the opposite direction, and secondly, it does not allow the material to de-compress or expand in the upward direction.

The roll-up machine comprises a set of three separate belt segments 4*a*, 4*b* and 4*c*, symmetrically 120-degrees apart, arranged in a circular fashion. For this particular configuration and mode of operation, all the belt segments 4*a*, 4*b* and 4*c* can be made identical; for other cases slight differences are required. For the clarity of description, only the belt segment 4*a* will be dealt with in detail; all the assigned reference numbers will be followed by the letter identifier "a" to accentuate the fact that only belt segment 4*a* is being referred to. The same logic applies to the belt segments 4*b* and 4*c*, the "b" and "c" letter identifiers, respectively, following the given reference number.

The belt segment 4*a* is a belt conveyor equipped with two outwardly travelling forming rollers 5*a* and 6*a*, and having its own belt tensioning system 7*a*. The belt tensioning system 7*a*, shown in FIGS. 7–10, 12 and 13, consists of two, joined together, moveable pulleys 8*a* and 9*a*, a stationary pulley 10*a*, and a force exerting and positioning cylinder 10'*a*. Conceptually, it is not that important whether the belt tensioning system 7*a* has two, joined together, travelling pulleys 8*a* and 9*a*, as shown in the above mentioned Figures, or just a single travelling pulley, depicted in some other Figures. Using a multiple pulley approach simply allows shorter stroke cylinders for a given belt take-up length. It is therefore, entirely a matter of practicality whether to use single or multiple tensioning pulleys.

Some due comments regarding tensioning cylinder 10'*a*. As will be explained in greater detail hereinafter, optimal performance requires that the tensioning system not only position the tensioning pulleys 8*a* and 9*a* as a function of winding time or the roll diameter at a given instant, but that it also properly adjust the belt tension as the roll diameter grows or the winding time elapses. To do this properly, tensioning cylinder 10'*a* has to be hydraulic, and some control algorithm is required to position the tensioning pulley(s), establish the belt tension, and control the hydraulic cylinder 10'*a* movement. The control algorithm can be developed analytically, but a more practical way is to develop it experimentally: preparing a good set of different diameter, rigid reference cylinders, and finding the hydraulic cylinder extensions by forcing the belts to tightly envelope the rigid cylinder reference samples with a pre-described force for a given cylinder diameter (tensioning the travelling pulley through a spring dynamometer until the correct force is exerted). Since the belts have a tendency to extend over the time, this procedure can be repeated from time to time, to re-calibrate the roll-up tensioning system.

If one decides to use an air cylinder or even a spring rather than a hydraulic cylinder, the roll-up machine will still work, but not at its peak performance level. Both the air cylinder and the spring are passive tensioning devices, meaning that they will advance as long as the restricting force will balance or nullify the driving force. Variable air pressure would be needed for the air cylinder to change the belt tensioning as the roll grows in time, and special characteristic mechanical springs would be required to do this particular job. Air cylinders would be more practical than mechanical springs, but either way, machine performance would be compromised.

Each forming roller is mounted so it can travel in the inward-outward direction on its own set of linear tracks, rails or guides. An hydraulic cylinder is preferably used as the forming roller positioning means, each forming roller having its own hydraulic cylinder.

For this particular geometry and this particular mode of operation, one can envision having just one common hydraulic cylinder serving two forming rollers of the winding space entry zone. A special control algorithm is needed to coordinate the positioning of forming rollers along the tracks during the roll winding process to maintain the shape of the circular cavity.

For the sake of clarity, the system for moving the forming rollers towards and away from the centre of the circular cavity is depicted in FIGS. 7–10 in a very simplified form: as two hydraulic cylinders and linear track assemblies 11*c* and 12*a* which act on two neighbouring belt segments 4*c* and 4*a*, respectively. This hydraulic cylinder-linear track system could be fabricated along these lines: a hydraulic cylinder, attached to the machine frame, acts upon a sliding mounting plate; the forming roller directly supported by this sliding mounting plate; the sliding mounting plate, equipped with four linear bearings, moves along two parallel, sufficient diameter circular cross-section shafts, attached to the machine frame. There are many different types of suitable sliding mounts commercially available.

Operation of Option 1:

The operation of the option 1 roll-up machine would proceed as follows.

The pre-cut length of the glass fibre insulation product enters the stationary pre-compression system 1, where it is gently squeezed or compressed between the horizontal conveyor 1*a*, and the height and/or angle adjustable inclined conveyor 1*b*, positioned above the horizontal conveyor 1*a*. The pre-compression system 1 is preferably equipped with some extra means of aiding air removal during the compression process, such as a perforated belt, perforated slots, and suction boxes. Depending on the approach, one can attempt to get the full product compression using only the pre-compression system, or splitting the total desired compression between the pre-compression system and the winding system. The compressed material emerges from the pre-compression system 1, and enters the circular cavity of the roll-up machine. The toe plate 3 prevents the decompression of the compressed material and also prevents it from touching belt segment 4*a*, which is running in the opposite direction.

Figure 7:
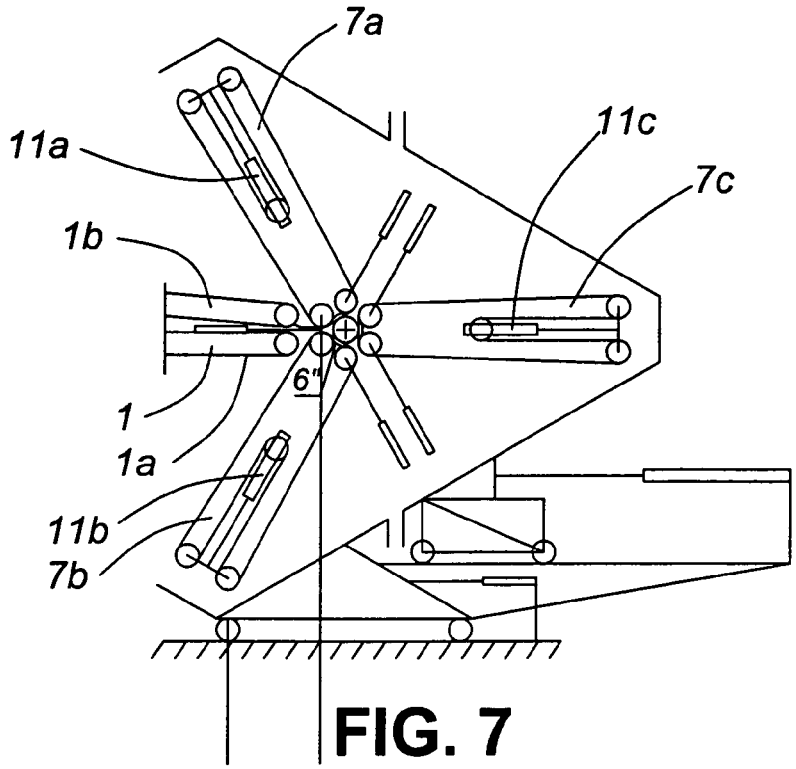
FIG. 7 presents a side elevation view of a first embodiment of the invention, in a starting position.

The roll-up machine starting configuration is shown in FIG. 7. There are six forming rollers: 5*a*, 6*a*, 5*b*, 6*b* and 5*c*, 6*c*, belonging to belt segments 4*a*, 4*b* and 4*c*, respectively. All six of these forming rollers are of the same diameter, and are evenly spaced in a regular hexagonal arrangement, the distance between adjacent forming rollers of different circumferential belt systems being equal to the sum of the roller diameter and the gap width between adjacent rollers. In the preferred embodiment, 4-inch diameter forming rollers were used, with a gap width of between 1-inch and 0.5-inch. Each forming roller has to be strong and stiff enough to take its load during the roll forming process, so its diameter cannot be too small; a 4-inch choice seems to satisfy. With these initial configurations one can start forming rolls as tight as 4.7" in diameter. Gaps of about 0.5" would allow the forming of rolls starting at 3.8" in diameter.

The central lines between the neighbouring forming rollers, belonging to the neighbouring belt segments, meet in the geometrical centre of the regular hexagon that the forming rollers lie on, the centre of this hexagon also being the fixed centre of the roll of product during the whole process of roll forming. Instead of moving radially outwards, and increasing the gap between adjacent belt systems as the roll diameter grows, the forming rollers are made to travel along tracks parallel to the above mentioned centre lines, therefore maintaining the initial gap between adjacent forming rollers all the time, regardless of the roll diameter.

The angle between the just described central lines is 120 degrees, so there is a full circular symmetry (a tri-fold one, to be precise) of the forming rollers configuration, this advantageous symmetry being maintained regardless of the roll diameter. The circular winding space or cavity 2 is formed by combining the active lengths or portions of the three separate belt conveyor systems 4*a*, 4*b* and 4*c*. Although there are two gaps in the winding space geometry, these gaps can be made small enough, typically between 0.5-inch and 1-inch, so for all the practical purposes this system still can be considered to be a continuous belt roll-up machine, with a fully enclosed or belt enveloped roll winding space. The winding space 2, rather than being of the "free-loop" or unsupported belt loop type, is substantially stiffened, the circular form retained and directly supported by a set of six forming rollers, distributed along the winding space circumference.

All three-belt segments 4*a*, 4*b* and 4*c* are independently driven such that the compressed material entering the winding space 2 is forced to roll up in the counter-clockwise direction. It is a matter of practicality which pulley or roller in these belt segments will be chosen to be directly driven by a gearmotor.

After entering the winding space 2, the compressed material is intercepted by the active belt length of the bottom belt segment or conveyor 4*b*, then meets the roll forming belt portion of the belt segment 4*c*, followed by a pressure contact with the belt stretch from the belt segment 4*a*, and is finally formed into the roll by a fresh length of the incoming compressed mat, when belt segment 4*b* is reached again. As the compressed material is being fed into the winding space 2, all the forming rollers are appropriately and positively positioned along their linear tracks by their respective hydraulic cylinders. There is a special governing logic behind the compressed roll forming process; a dedicated control algorithm is used to execute the controlled outward movement of the forming rollers as a function of time or as a function of the length of compressed material that has been fed into the roll-up machine. The algorithm for controlling the position of the forming rollers is relatively simple and straightforward.

Forming rollers, when moving in the outward direction during the roll forming or winding phase, are in an "active" mode of operation, meaning that their actual position is solely determined by their hydraulic cylinder extensions, rather than simply being pushed away by the growing diameter roll of compressed product as the winding time elapses. Obviously, these two parameters are directly related, the control algorithm positioning the forming rollers using their respective hydraulic cylinders. It is possible to envision a passive mode of operation of forming rollers during the roll ejection stage, and following it, the return to the starting configuration, where the forming rollers could be pushed back by their belt when the belt tensioning system forces the belt conveyor system to assume its initial configuration.

When the roll diameter grows, the forming rollers are displaced along their linear tracks in the outward direction by their respective hydraulic cylinders in a controlled fashion, providing enough room to properly accommodate the compressed roll being formed. During the forming rollers outward travel, the distance between two forming rollers belonging to the same belt segment or belt conveyor system inevitably increases, so for the closed loop belt system, it directly translates into taking this extra belt length from the other part of the endless belt system. This extra belt length is managed by the take-up system (7*a* for the belt system 4*a*).

As described above, the take-up system consists of an hydraulic cylinder and a separate control algorithm for positioning the travelling pulley(s) of the belt tensioning system. The control system controls the belt tension according to a pre-determined relationship, as a function of the instant roll diameter. Other, more conventional tensioning means could also be used, such as air cylinders or mechanical springs, but these would not meet the typical performance requirements for large industrial applications.

Figure 14:
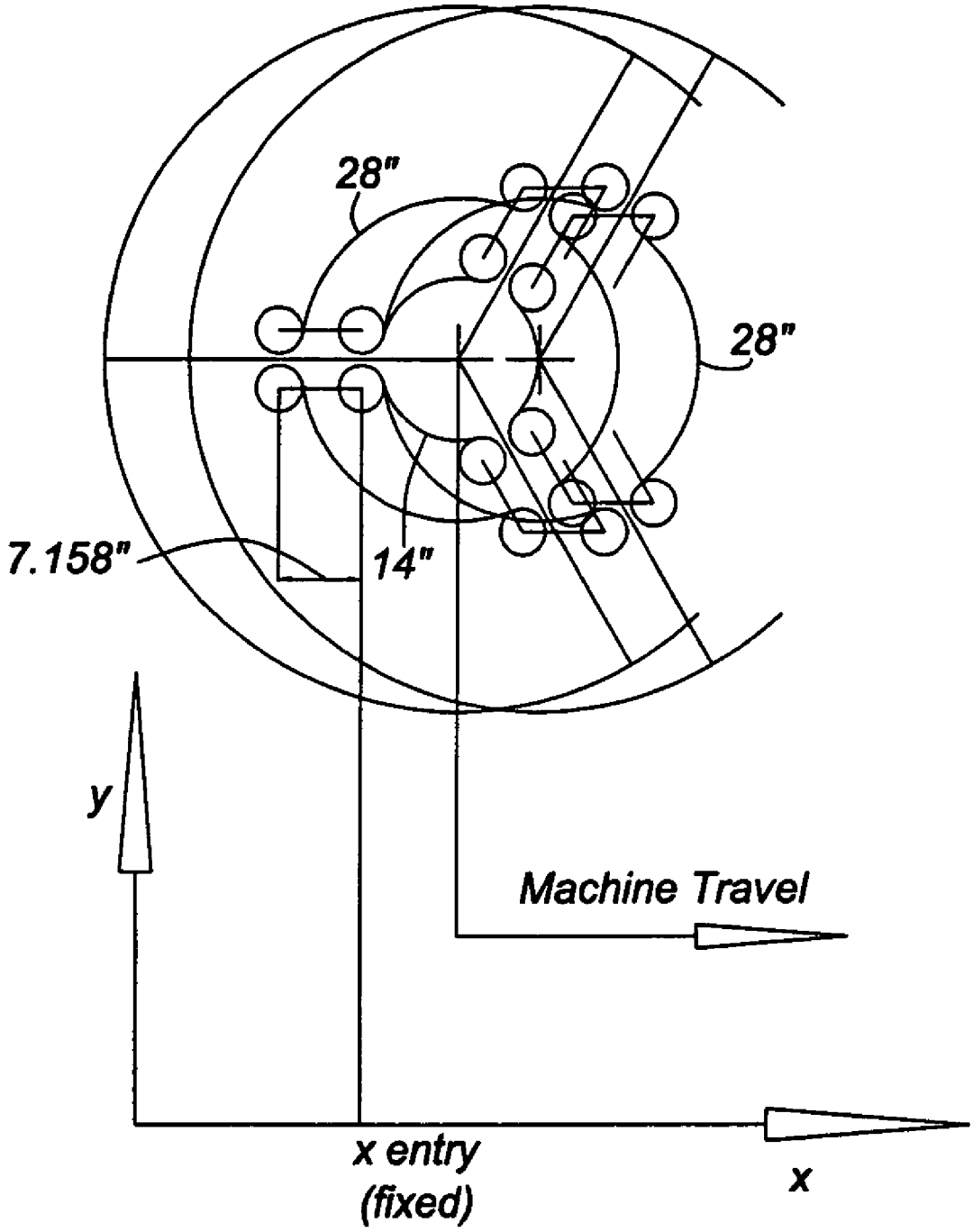
FIG. 14 presents a side elevation view of a first embodiment of the invention, showing how the rollers must be translated in a fixed entry design, to maintain proper roll geometry.

As the roll forming process continues, the roll diameter gradually increases, and the forming rollers move in the outward direction, always retaining the full 120-degree symmetry of the roll winding configuration, and keeping the gap between pairs of forming rollers belonging to neighbouring belt loops, constant. The forming rollers are moving outwards, but the manufacturing line, as such, is stationary; thus, there is a conflict which must be resolved. The forming rollers 5*a* of the belt segment 4*a*, and 6*b* of the belt segment 4*b*, move in the direction opposite to the line direction, so a natural way to compensate is to move the whole roll-up machine in synchronization with the growth of the roll, in the line direction. FIG. 14 clarifies this strategy in more detail. To keep the roll-up machine feed point stationary, the two partial movements are combined together, namely: the forming rollers 5*a* and 6*b* outward movement in the direction opposite to the line direction, and the equal travel of the roll-up machine as a whole, in the opposite direction.

The roll-up machine, rather than being stationary, is mounted on its own set of wheels and tracks, so it can travel in the line direction. A hydraulic cylinder 13, at one end fixed to the roll-up machine floor, controls the precise movement of the roll-up machine in the line direction. Basically, the same control algorithm used for the forming rollers, is good for the hydraulic cylinder 13 because the entire roll-up machine must be displaced by the same distance as roller 6*b*, since the roller 6*b* and the entire roll-up machine (hydraulic cylinder 13) displacements are parallel. Other mechanisms for executing the synchronized and fully controlled travel of the roll-up machine in the line direction can also be envisioned, for example, as a mechanical linkage, forming rollers 5*a* and/or 6*b*, or their hydraulic cylinders, being the drivers.

Figure 8:
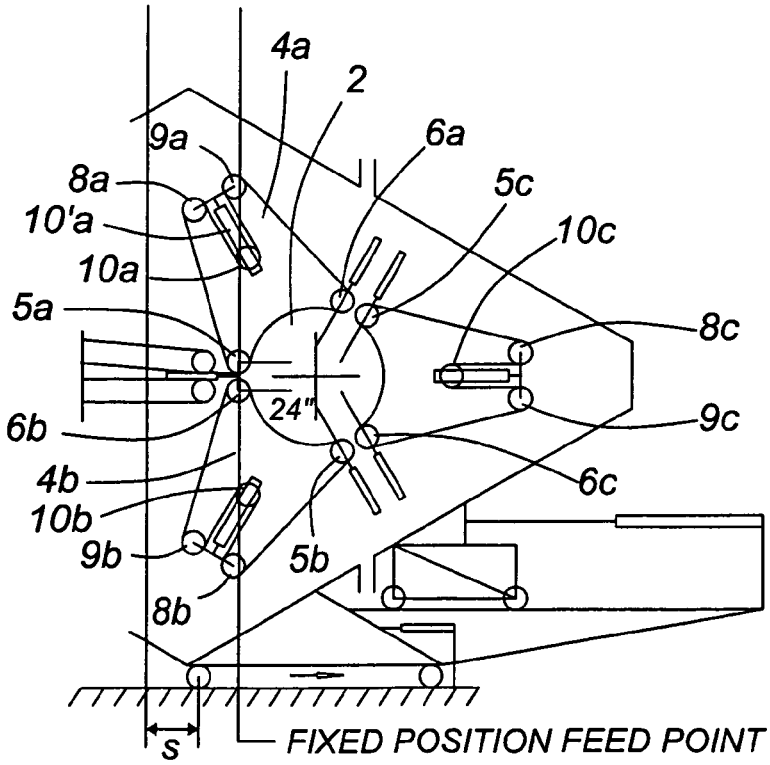
FIG. 8 presents a side elevation view of a first embodiment of the invention, in a finished position.

Contrasting FIGS. 7 and 8 shows how the roll-up machine is to be moved between the start and the end positions for rolling up a 24-inch diameter roll, and keeping the feed point stationary, to meet the stationary pre-compression system 1. The start position roll diameter is 6-inch, or actually only 4.65-inch, if restricted to a small triangular winding space, better shown in FIG. 11 (FIG. 11 shows an exemplary arrangement for establishing a starting diameter of 4.65-inches).

Given six, 4" diameter forming rollers, arranged in a circular starting configuration, with a 1" gap between the neighbouring rollers, making a 28" diameter roll requires moving the whole machine in the line direction by slightly less than one foot. The distance required and the rate at which the machine is moved, will change with the particular dimensions of the application. It would be straightforward for one skilled in the art to perform such calculations from the teachings herein.

Just before finishing the roll winding step, the process of over-wrapping the compressed roll with kraft paper or plastic foil, begins. The main objective of the roll over-wrapping is to prevent roll de-compression or expansion, keeping the roll in its highly compressed state. To some extent this plastic foil works also as protection against the elements, but usually single rolls are later unitized in packages, for example, in groups of four rolls, and this final package is then additionally compressed and reasonably well weather protected by a stretch wrapping process, done, for example, in a ring-wrap machine. The main purpose of unitizing is to make the roll packages stable enough to be vertically stackable, saving warehouse floor space and making the product easier to handle with fork-lift trucks and similar equipment.

Before the product roll is fully wound or rolled-up, the leading end of the plastic foil or film is dropped on the top surface of the uncompressed material, and is drawn with it through the pre-compression system, over-wrapping the compressed roll in the circular cavity. Typically, the insulation will be wrapped 1.5 to 2 times, and then sealed along its long edge(s) by having the plastic film loose or trailing end, with earlier applied glue or hot melt strips, coming into the contact with the foil length already enveloping the compressed roll.

It is also possible to feed the plastic film from the bottom, through some gap between the transfer conveyors, and before the pre-compression section. The are many alternative designs for the addition of plastic film that would be clear to one skilled in the art from the description of the invention. The invention is not limited, per se, by the nature of the plastic film system used.

After having the roll of insulation material properly wrapped with the plastic foil, the roll is ready for ejection from the roll-up machine. Since the roll-up machine produces a highly compressed roll (approximately 10:1 compression ratio for fibreglass insulation, though higher ratios may be obtained for other compressible materials), it is to be expected to see some expansion after releasing it from the tight circular-winding cavity. Thus, it may be necessary to move the forming rollers before physically opening the winding space to let the roll drop out.

Figure 9:
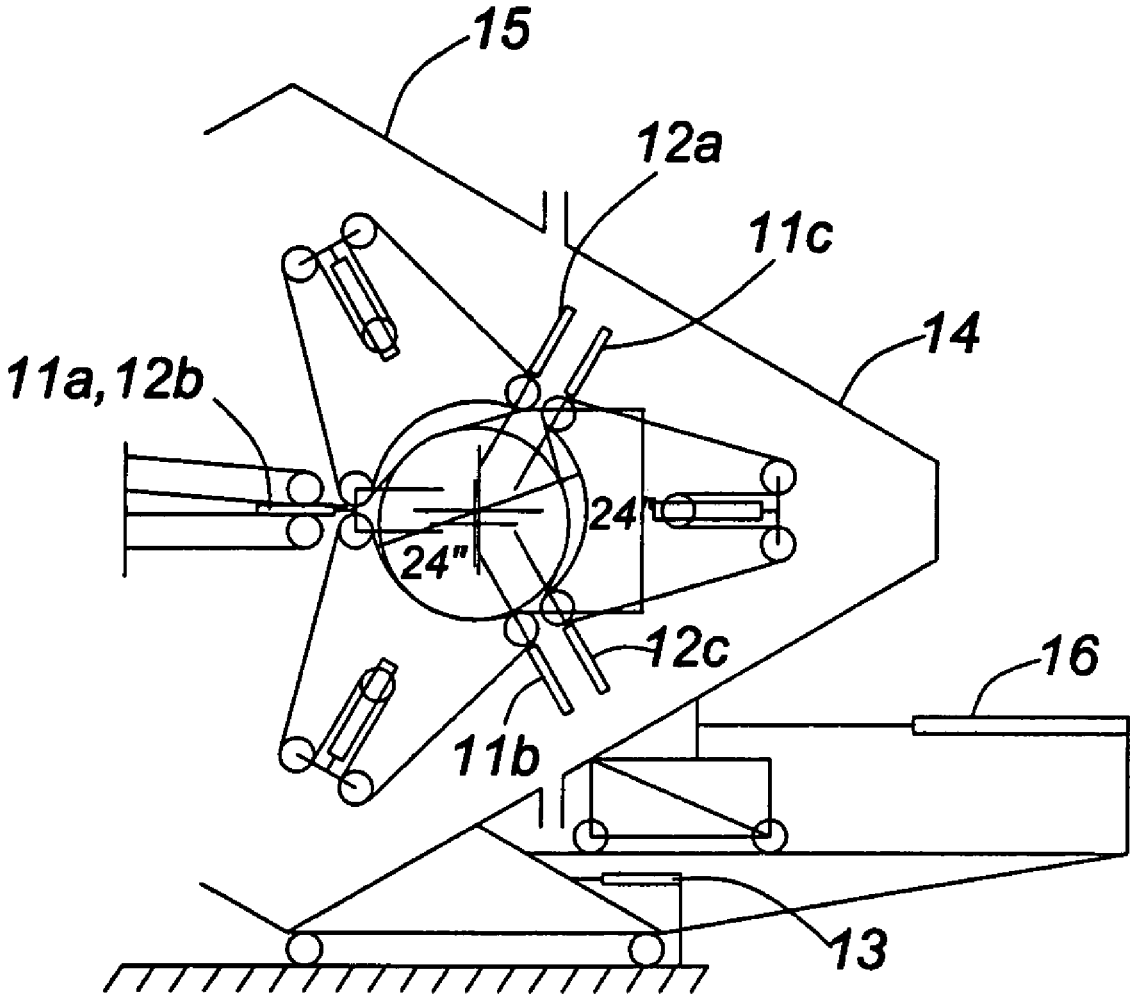
FIG. 9 presents a side elevation view of a first embodiment of the invention, in the process of ejecting a finished roll.

FIG. 9, illustrates the case. All the belt loops 4*a*, 4*b* and 4*c* have been opened enough that the compressive pressure on the plastic film wrapped roll has been relaxed, and that the roll can pass freely through an exit space that will be created between the forming rollers. After opening-up the circular winding space in this manner, the inner belt lengths will be no longer circular arc shaped, but will largely straighten-up, assuming a more rectilinear geometry. This will help to force the roll out of the roll winding space, making the roll ejection easier and somewhat faster.

Figure 10:
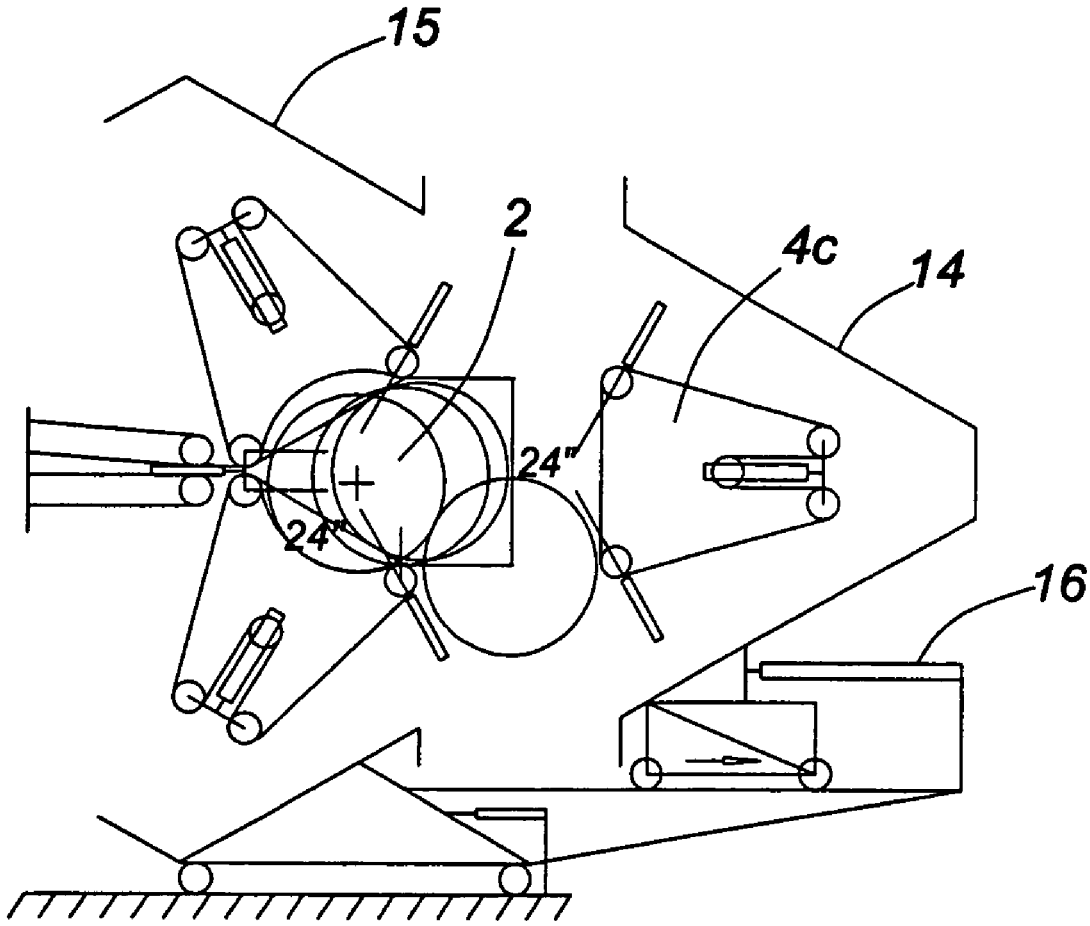
FIG. 10 presents a side elevation view of a first embodiment of the invention, in the process of ejecting a finished roll by translation of a belt segment.

Certainly, there are many possible ways of ejecting completed rolls from the wind-up machine. FIG. 10, for example, depicts the option of roll ejection by moving the belt segment 4*c* back by a simple translation.

Belt segment 4*c*, including its forming roller hydraulic cylinder-linear track systems 11*c* and 12*c*, is supported by a subframe 14 equipped with its own set of wheels. Subframe 14, in turn, rests on tracks, mounted on the roll-up machine main frame 15. A pneumatic cylinder 16, attached at one end to the main frame 15, can move the whole subframe 14 quickly back, thus opening the winding space 2 for roll ejection. The roll is ejected by gravity; the straightened-up belt lengths offering some assistance in pushing the roll out and further guiding it during the ejection stage.

Figure 12A:
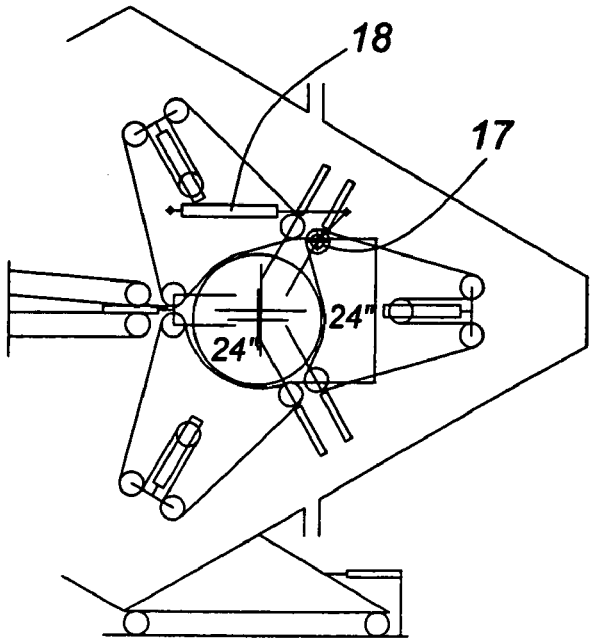
FIGS. 12A and 12B present a side elevation view of a first embodiment of the invention, in the process of ejecting a finished roll by rotation of a belt segment.
Figure 12B:
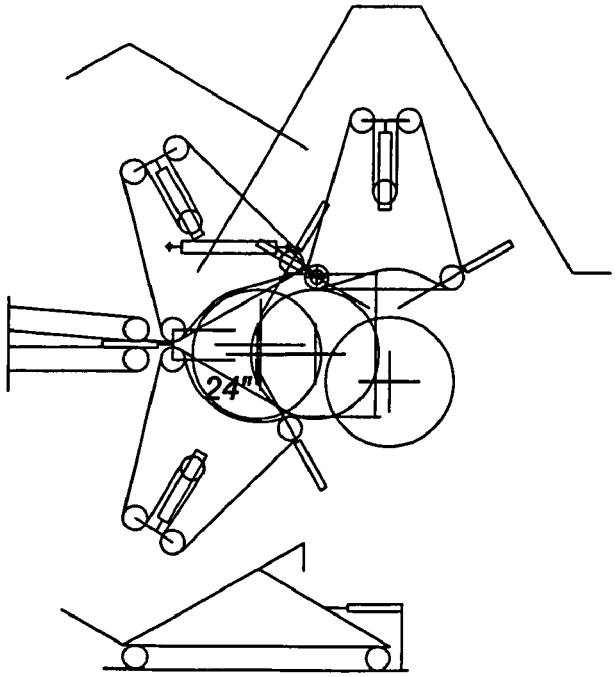
Figure 13:
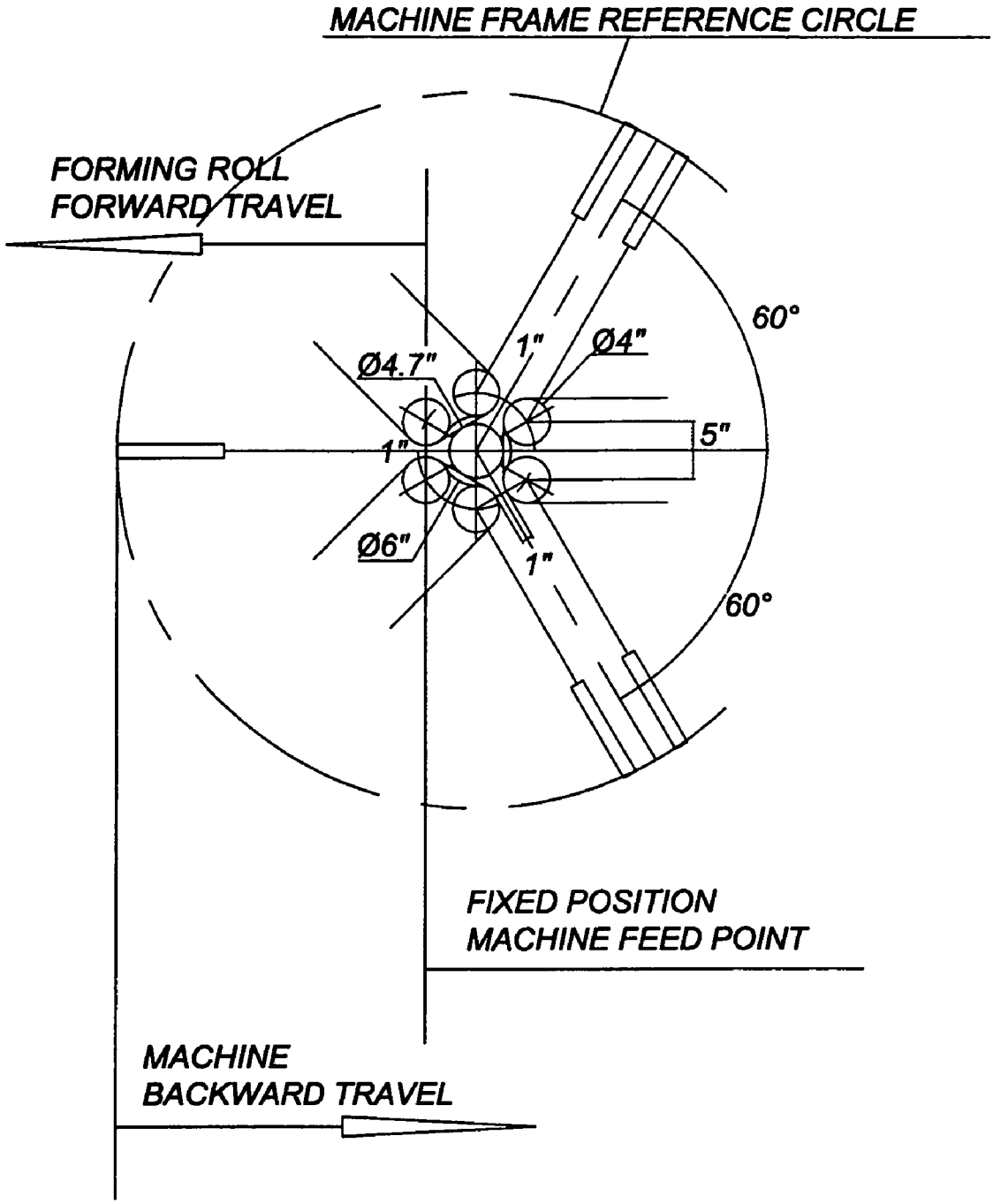
FIG. 13 presents the starting geometry of a first embodiment of the invention.

Alternatively, the winding space could be opened for roll removal by rotation, rather than translation. FIGS. 12A and 12B illustrate this option schematically. The subframe 14 can turn around a fixed swivel point 17, the swivel point 17 being directly mounted on the main frame 15 (on both sides, of course). Physically, the swivel assembly 17 comprises a bearing with a short piece of shaft mounted in it. A pneumatic cylinder 18, is attached at one end to the roll-up machine main frame 15, and at the other end to a point on the subframe 14, placed sufficiently away from the swivel point 17 to provide some leverage advantage. It is possible to design this embodiment in such a way that the forming roller 5*c* of the belt segment 4*c*, before attempting to swivel the subframe 14, assumes a position that its centre coincides with the swivel line or axis. In this way, there is no possibility of interference with the product roll or any other mechanical members of the roll-up machine during the swivel stroke.

It is well understood that other options for removing the roll from the roll-up machine do exist. For example, one could simply push the roll out to the side.

It is important that the continuous belts be kept under sufficient tension all the time, to avoid leaving their tracks, rollers or guides. There is no problem during the roll forming and roll wrapping stages as a control program or programs take care of positioning both the forming rollers and the tensioning roller. However, the situation changes drastically during the roll ejection stage, and the subsequent return to the roll-up machine starting configuration, to become ready for the next roll processing.

To make sure that the loose belt problem will not occur during this stage of the machine operation, certain precautions should be taken. The belt tension does not have to be as high during the ejection process as it was during the roll forming process, but it still has to be sufficient not to let the continuous belts leave their V-grooved tracks. Having hydraulic cylinders for both the forming rollers and the tensioning rollers causes a problem as they may not be able to perform their return strokes fast enough to prevent belt slack after roll ejection.

One possibility, is to program the return movements of both the forming rollers and the tensioning rollers in such way that the continuous belts should, in principle, never become loose. However, it is not straightforward to design fully reliable control programs either analytically or experimentally, particularly because the continuous belts tend to stretch over time and it is difficult to compensate for this slack using software. This could be resolved with frequent re-calibration, but this is not a practical solution.

Another option, which seems much more practical, easy to implement and fully reliable, is to have two hydraulic cylinders, programmed for the fastest practical rate of return travel, and to have an auxiliary mechanical spring or air cylinder system to take care of the differences between the hydraulic cylinders and their associated belt lengths at a given instant.

In other words, the start and finish positions for both the tensioning rollers and the forming rollers are known, as is the end point for the return stroke. The issue is therefore which path to follow between these two known points. This can be resolved as follows:

1. arbitrarily choose some position-time curve for the forming rollers, and make this back movement as fast as practical; and
2. specify a position-time curve (control program) for the return stroke of the tensioning rollers. Design this curve in such a way, that the belt length taken-up by the take-up rollers is always, but only slightly, less than the belt length released by the forming rollers during its return travel. Only the start and finish positions match each other, so theoretically, there will be no belt slack for these two positions (assuming that the belt has not stretched yet).

This yields two different return stroke algorithms, one somewhat arbitrarily chosen (that of the forming rollers), the other established analytically or graphically, without any special difficulty (for the tensioning rollers).

An auxiliary mechanical spring or pneumatic cylinder system, not shown in the drawings, can now be used to take care of this deliberately introduced belt slack. The mechanical spring or hydraulic cylinder system has to take care only of the length differences. For example, if the forming rollers yield an extra 10 inches of belt length and the tensioning rollers are programmed to absorb only 9 inches of belt length, the auxiliary spring or compressed air loaded tensioning system has to compensate for 1 inch only, rather than 9 or 10 inches.

The use of an auxiliary system to compensate for the small length differences between what is taken-up and given-off at a given instant, allows the use of a simply derived control program for controlling the return movements of the forming and tensioning rollers. In fact, the control algorithm does not have to be changed at all from the ideal conditions. The length difference has to be in the right direction, that is, one must always release slightly more belt length than is taken up at a given instant. If more belt length is taken up than released, the hydraulic cylinders would break the belt. To take up the small belt slack, a spring or pneumatic cylinder is used to provide auxiliary tensioning, always acting during the return stroke, and basically idle (because it has too small a force) during the roll winding stage. This approach also addresses the issue of belts stretching over time, of course, each loop system would require its own mechanical spring or pneumatic cylinder-based tensioning system.

One can also envision the possibility of controlling the return motion of the tensioning roller while operating the forming roller cylinder in some idle mode, where the belt pushes the cylinder piston against some hydraulic oil back-pressure only. In other words, the tensioning cylinder could be active on roll ejection and the forming roller cylinder passive. While this may not be accommodated by most hydraulic systems, the issue of belt stretch would automatically be taken care of.

Although it is not a particular challenge to have a roll-up machine built with the associated line direction travel ability, the preferred option is to deal with a fully stationary roll-up machine. That is, a roll-up machine that is bolted to the floor. Further considerations, therefore, assume the roll-up machine to be stationary.

Option 2

This embodiment is based on the following design parameters:

1. stationary roll-up machine;
2. not a fixed feed point;
3. fully symmetrical forming rollers arrangement (120-degrees);
4. all six forming rollers moving outwards;
5. flip-flop conveyor added;
6. no gap between the bottom feed conveyor and the bottom, roll-forming belt segment; and
7. since they are both integrated into a one-belt conveyor, a pre-compression belt conveyor system travelling backward.

This is only a slight modification of the basic case (Option 1), and is shown in FIGS. 15 through 18B, covering the full operational cycle of the roll-up machine. The roll-up machine is stationary, but both the material feed point, as well as the pre-compression belt system, travel in the direction opposite to the line direction. Between the main transfer conveyor and the roll-up machine there is a short flip-flop conveyor.

Figure 15:
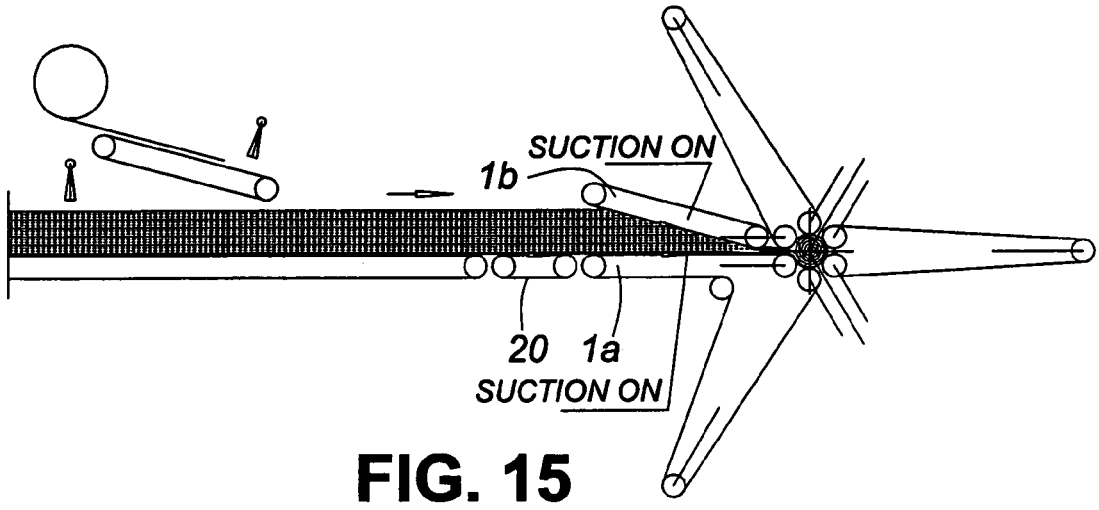
FIG. 15 presents a side elevation view of a second embodiment of the invention, in the starting position.
Figure 16:
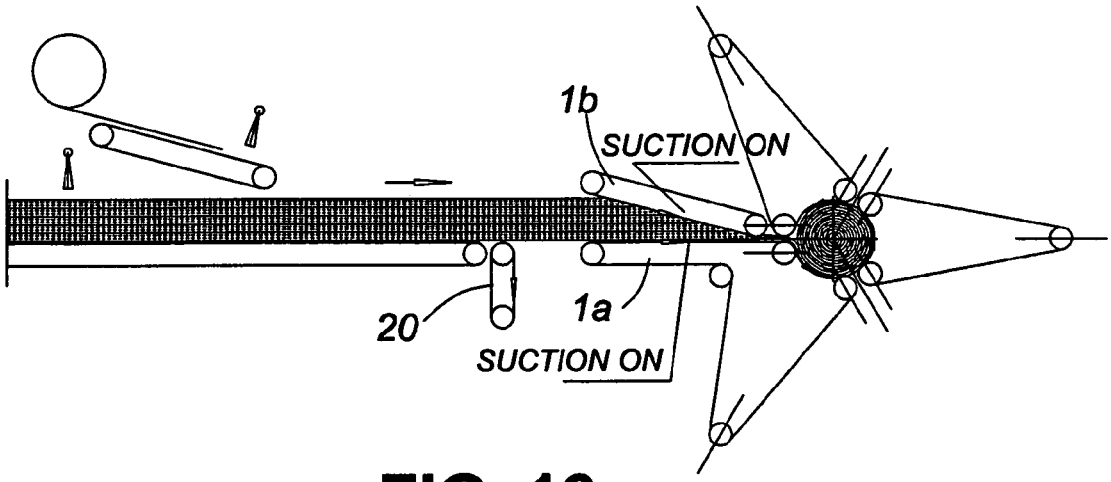
FIG. 16 presents a side elevation view of an apparatus in a second embodiment of the invention, in the process of winding up a roll.
Figure 17A:
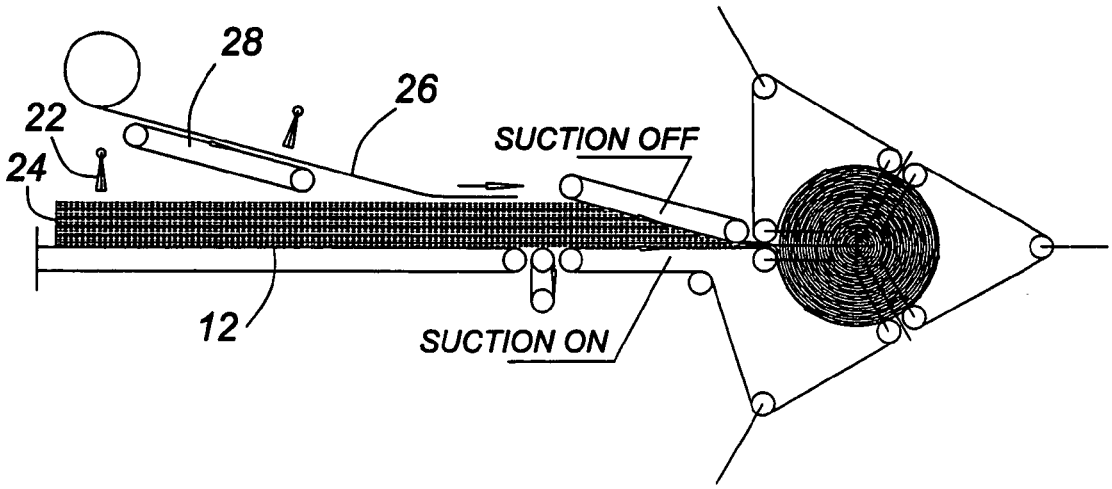
FIG. 17A presents a side elevation view of an apparatus in a second embodiment of the invention, in the process of applying wrapping film or foil to a finished roll.
Figure 17B:
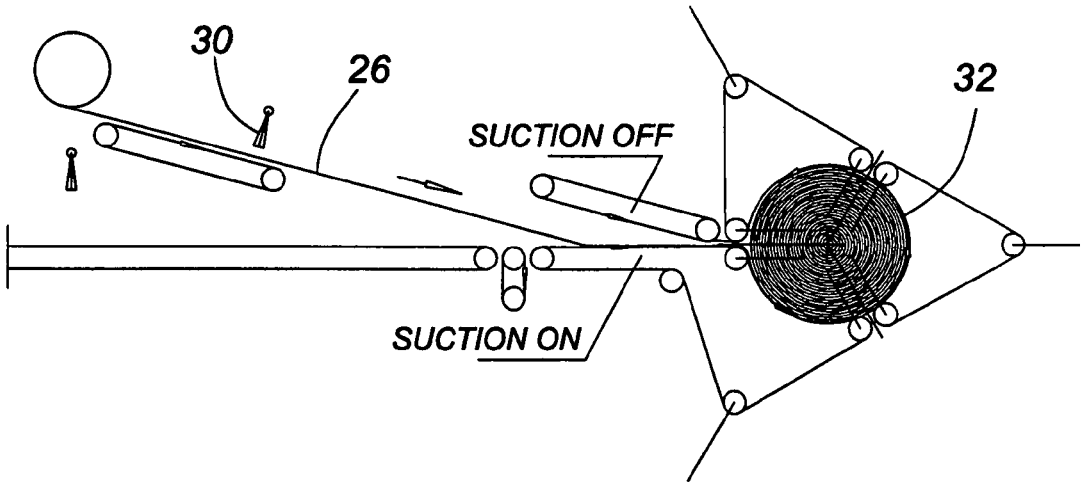
FIG. 17B presents a side elevation view of a second embodiment of the invention, in the finished position.

The process proceeds in the following manner:

1. as shown in FIG. 15, at the starting phase of the roll winding process, the forming rollers have not yet been extended outwardly and the uncompressed material is fully supported by the belt conveyors;
2. after this start-up period, the flip-flop conveyor 20 is turned clockwise by 90 degrees to make room for the backward travelling pre-compression system, as shown in FIG. 16. The compressible material is unsupported only over the short length at this point;
3. when the roll is fully formed, the bottom conveyor of the pre-compression system comes close to the vertically positioned flip-flop conveyor. As shown in FIG. 17A, optionally, a strip of glue may be sprayed on the top of the uncompressed material 12 by a lower spray nozzle 22, towards the end 24 of the uncompressed material 12. This strip of glue will bond the uncompressed material 12 to an already pre-cut length of wrapping film 26, which may be advanced forward in a timely fashion by the inclined, above the line, dispensing conveyor 28;
4. referring to FIG. 17B, close to the trailing end of the wrapping foil length, a strip of glue is applied to the plastic foil 26 using a second spray nozzle 30. This second strip of glue will bond the plastic foil 26 to itself as it is wrapped around the now compressed roll of material 32;
5. finally, the roll is ejected by opening-up the roll forming space either by a translation or rotation of one of the belt segments.

Figure 18A:
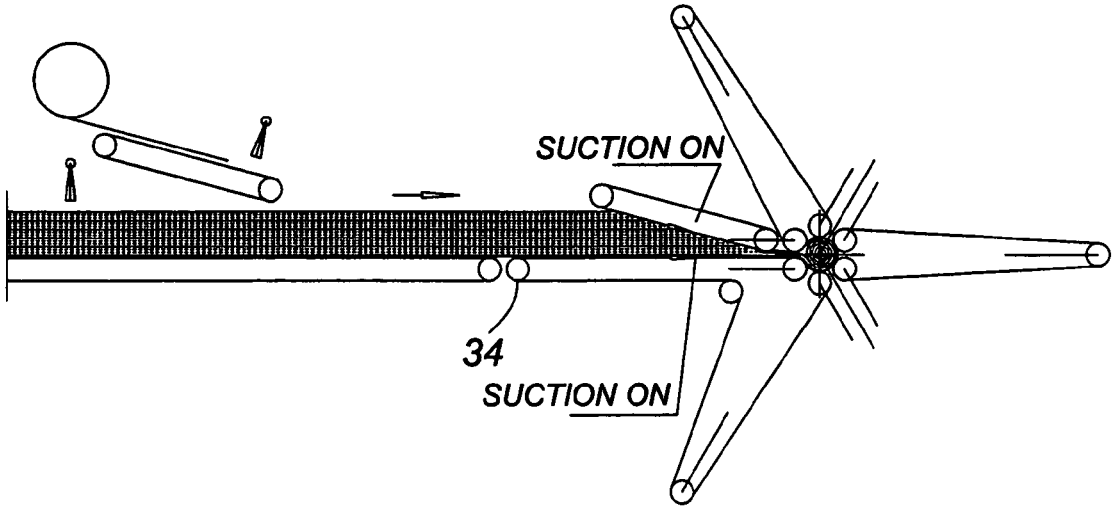
FIGS. 18A and 18B present a side elevation views of the second embodiment of the invention wherein the flip-flop conveyor 20 is replaced by a bottom roller which is movable.
Figure 18B:
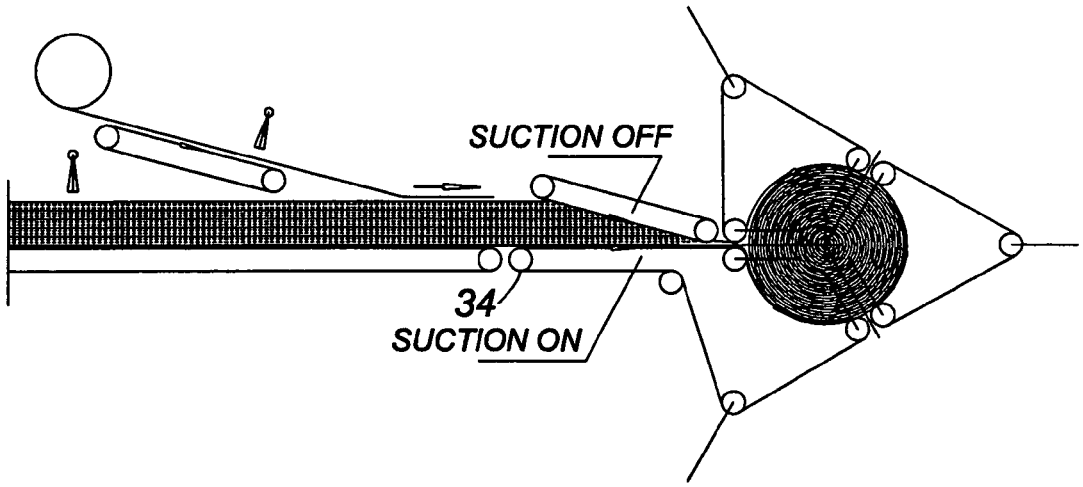

Alternatively, rather than using a rotatable flip-flop conveyor 20 as shown in FIGS. 15 through 17B, the translation of the roll-up machine can be dealt with means of the design shown in FIGS. 18A and 18B where the bottom roller of the bottom belt segment 34, is translated as required. While this design does not require the flip-flop conveyor 20, it does require that the control algorithm for the lower belt 36 be different from those of the other two belts.

Option 3

This embodiment is based on the following design parameters:

1. stationary roll-up machine;
2. stationary pre-compression belt conveyor system;
3. a fixed feed point;
4. stationary entry zone forming rollers; and
5. all six forming rollers beginning in a circular configuration, but only four roll forming rollers extending outwards at 60 degrees.

Figure 19A:
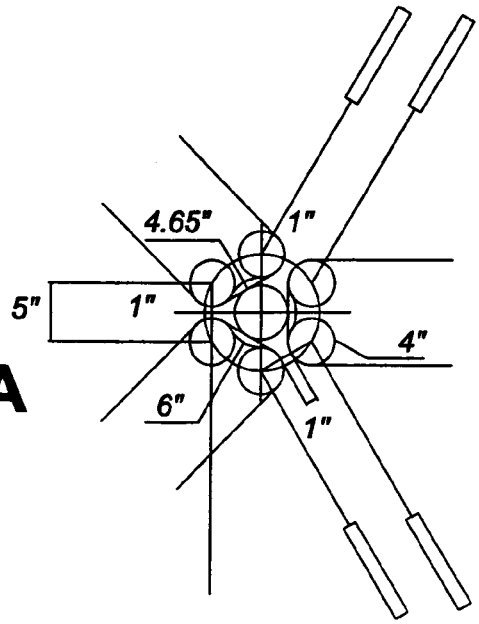
FIGS. 19A, 19B and 19C present side elevation views of a third embodiment of the invention.
Figure 19B:
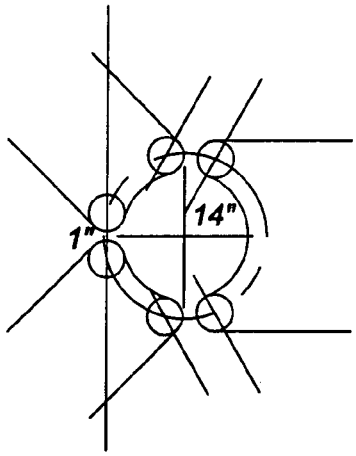
Figure 19C:
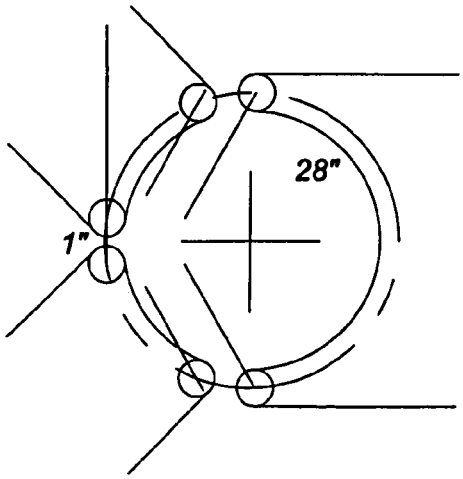

The sequence of configurations involved in the process of making the roll of compressible product by following the Option 3 guidelines is illustrated in FIGS. 19A–19C. At the beginning of the roll-forming process, each belt segment covers approximately 120 degrees of the compressed roll (see FIG. 19A). However, as the roll grows in diameter, the 60 degree travel of the four forming rollers causes an increasing degree of asymmetry in the contributions made by each belt segment (see FIG. 19B). By the time the compressed roll reaches a certain size, the belt segment facing the entry point is responsible for approximately half of the roll circumference (see FIG. 19C). One can still form rolls this way, particularly if smaller diameters are involved, but this asymmetry, well pronounced for the larger diameters, has its definite drawbacks (different take-up lengths, only partially reduced as compared to the continuous belt loop case, and different belt tensioning, for example).

Still, this design offers many advantages, including the following:

1. both the roll-up machine and the pre-compression system are stationary, so no retraction mechanism or control algorithm is needed; and
2. only four forming rollers move outwardly, so less hardware and control equipment is needed than the embodiments which require six forming rollers to move.

The only issue is how to keep all three belt systems symmetric, while keeping the roll-up machine and pre-compression system stationary, and only moving four of the forming rollers outwardly. Options 4 and 5 address this issue.

Option 4

This embodiment is based on the following design parameters:

1. stationary roll-up machine;
2. stationary pre-compression belt conveyor system;
3. a fixed feed point;
4. stationary entry zone forming rollers; and
5. four forming rollers extending outwards, at some angle to horizontal in the range of 25 to 45-degrees (not a fully symmetrical belt arrangement).

To obtain full symmetry in the belts forming the circular cavity, the forming rollers must be arranged with a 120-degree angle between neighbouring sets of forming rollers. With just four forming rollers extending outwardly, the tracks for the four forming rollers cannot follow a 120-degree angle (60-degrees to the horizontal) or a lack of symmetry will result as shown in FIGS. 19A–19C. Symmetry can be improved, however, by tilting the forming roller tracks so the angle between them will be substantially less than 120 degrees.

Figure 20A:
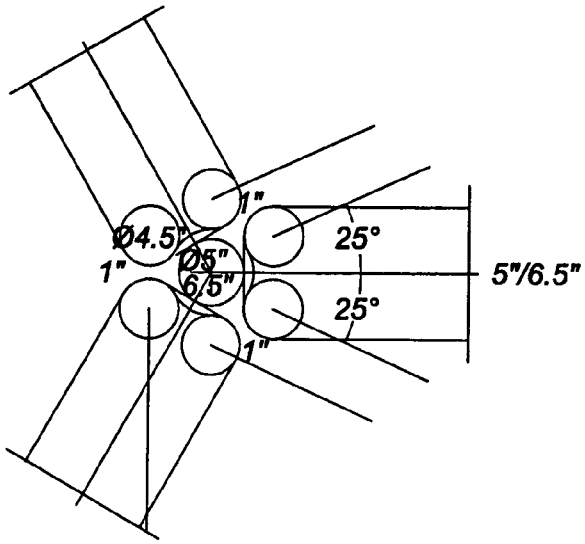
FIGS. 20A, 20B and 20C present side elevation views of a fourth embodiment of the invention.

FIG. 20A shows the forming rollers in a starting configuration, with the linear tracks inclined by 25-degrees with respect to the horizontal, rather than by 60-degrees, as has been the case for the fully symmetrical forming rollers arrangement. Forming rollers 4.5" in diameter were used in this simulation, with 1" spacing between them, arranged in a circular configuration with 5.5" between axles of forming rollers in the starting configuration. As noted above, the entry zone rollers are stationary and the four travelling rollers move along linear tracks with a 25-degree incline.

Figure 20B:
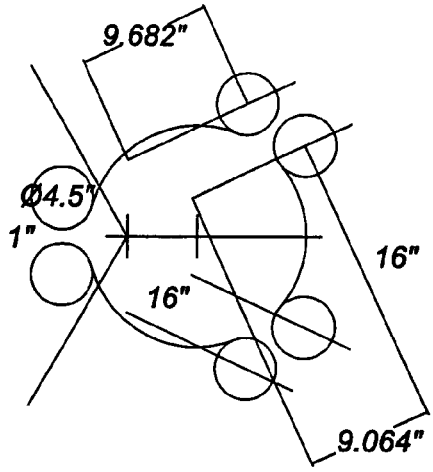
Figure 20C:
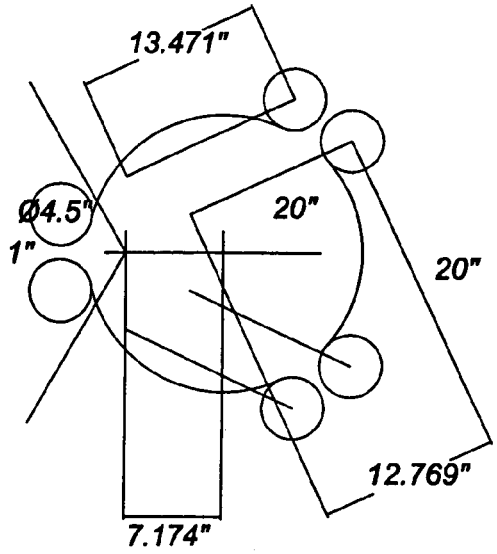

FIGS. 20B and 20C depict subsequent stages of the roll forming, up to a 20" diameter roll. It is apparent that this time the contributions made by each belt segment are about the same, providing a number of benefits over the design of Option 3.

Figure 21:
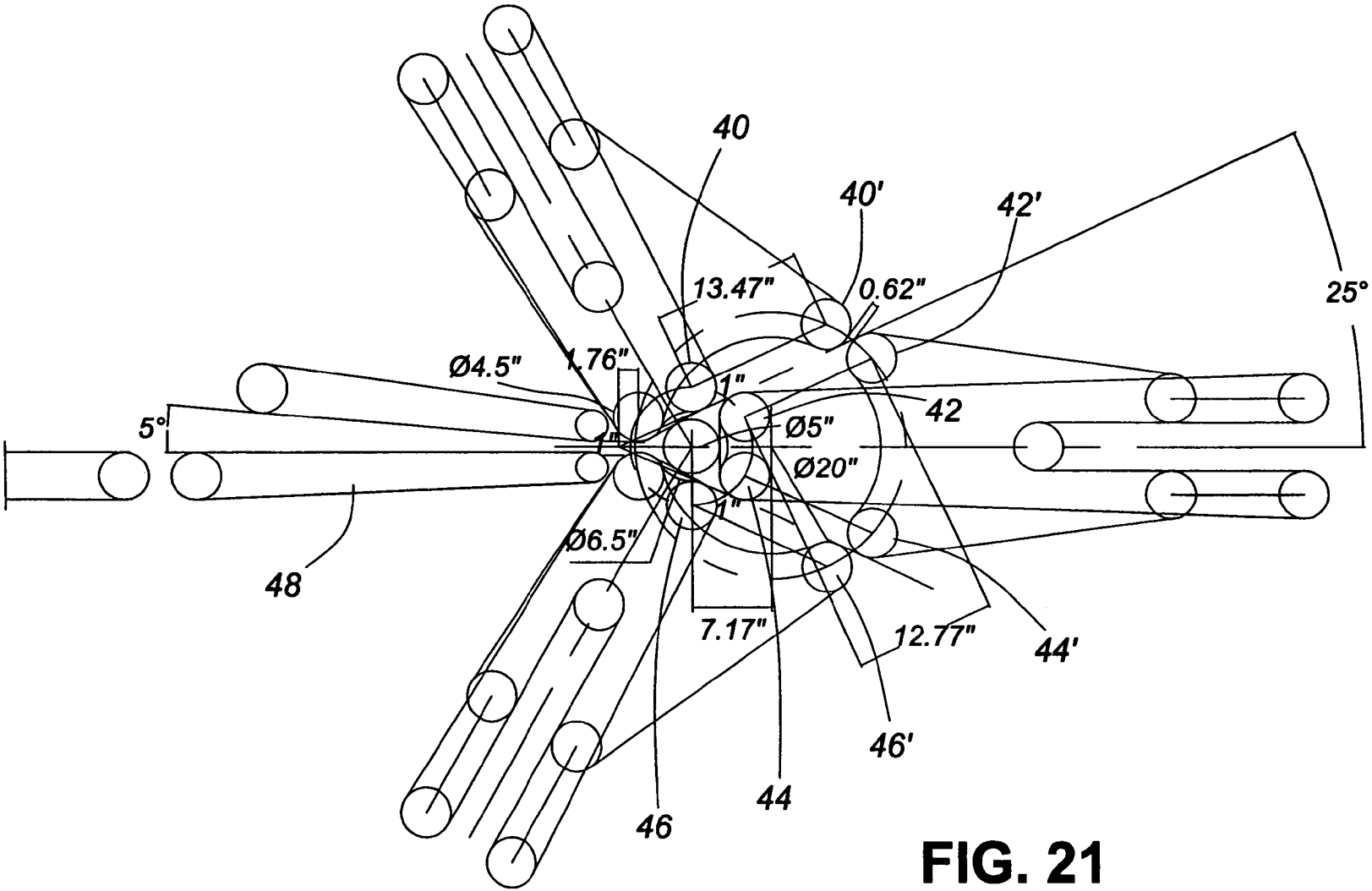
FIG. 21 presents a side elevation view of a fourth embodiment of the invention, demonstrating that moveable rollers and belts will not interfere with one another during the winding process.

If one requires a perfectly circular roll shape during the whole roll forming process, two control programs are really required to properly position the forming rollers during the roll winding. Using a single algorithm and displacing the forming rollers by the same distance, will cause forming rollers 5*b* and 6*a* to be closer to the centre of the roll, than forming rollers 5*c* and 6*c*. This will cause a small dent on the product roll surface, but will generally be so small that it is of no practical importance. Thus, a single control program can be used. Note that care must be taken to ensure that adjacent forming rollers do not interfere with one another. As shown in FIG. 21 and discussed below, it is straightforward to avoid interference.

Using two control algorithms, and a 25-degree incline, the forming rollers can be displaced to result in a perfectly round circular cavity.

FIG. 21 schematically shows a general arrangement for a stationary roll-up machine, with a stationary pre-compression belt conveyor system, having the four forming rollers travelling along 25-degree inclined linear tracks. Two control programs were used for forming roller positioning, with the gap between adjacent rollers dropping from an initial 1" gap, to a 0.62" gap at the maximum roll diameter. There is still no interference between the belts or rollers with such a configuration, as the four movable rollers travel through the following paths:

1. roller 6*a* moving position 40 to 40';
2. roller 5*c* moving position 42 to 42';
3. roller 6*c* moving position 44 to 44';
4. roller 5*b* moving position 46 to 46';

Note that the control algorithm causes forming rollers 5*c* and 6*c* to travel 12.77" through the entire process and forming rollers 5*b* and 6*a* to travel 13.47".

This 25-degree inclined roll-up configuration is quite useful, but still may be improved upon. Option 5, to be described hereinafter, is generally the optimal configuration, using a 30-degree inclined design.

Note that in FIG. 21 the bottom feed conveyor 48 of the pre-compression system is not a part of the bottom roll forming belt segment as it was in FIGS. 17 and 18, but clearly, these two conveyors can be integrated if desired.

Option 5

This embodiment is based on the following design parameters:

1. stationary roll-up machine;
2. stationary pre-compression belt conveyor system;
3. a fixed feed point;
4. stationary entry zone forming rollers; and
5. four forming rollers extending outwards, at 30-degrees to the horizontal.

While the four forming rollers may be guided at an angle anywhere from 20–60 degrees to the horizontal, it has be found that symmetry of the three continuous belts can still be maintained in a stationary roll-up machine configuration. It has been determined, both graphically and analytically, that symmetry is maintained when the moveable forming rollers travel along 30-degree inclined linear tracks.

Figure 22A:
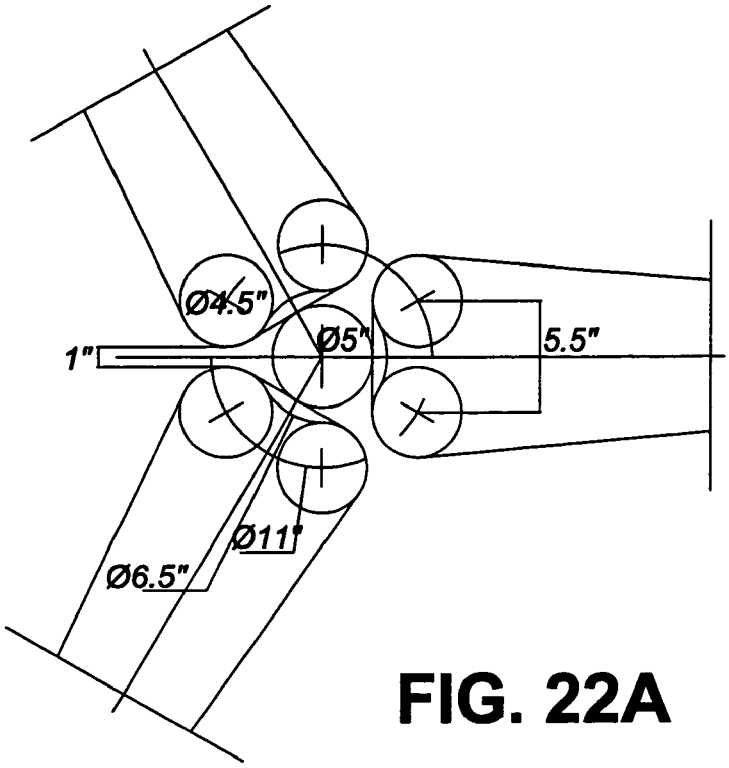
FIGS. 22A and 22B present side elevation views of a fifth embodiment of the invention, showing how the optimal angle of travel for the four movable rollers can be calculated graphically.
Figure 22B:
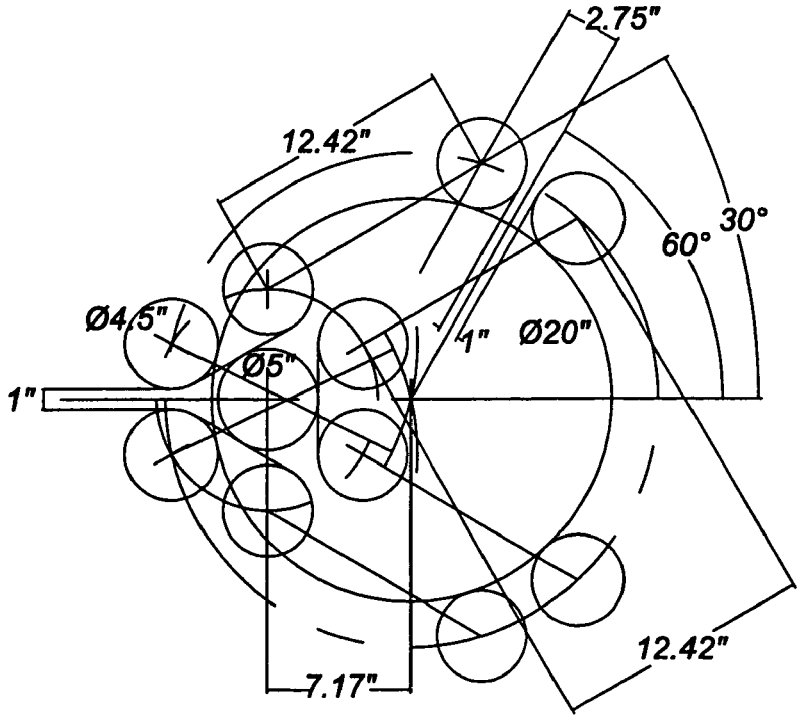

The graphical procedure for finding the optimal tilt angle may be shown with respect to FIGS. 22A and 22B:

1. the forming rollers are evenly spaced about a circle in the starting condition, with roller diameters 4.5", and the gap between the rollers being 1", as shown in FIG. 22A. The final product roll diameter is 20" as shown in FIG. 22B. Thus, from the centre of the entry zone stationary forming rollers, arcs can be drawn with a 12.25" radius (half of 20" plus 4.5"). The intersection point of the two arcs is the centre of the 20" diameter product roll;
2. from the centre of this 20" roll, a 24.5" diameter circle can be drawn to identify the centre points of the forming rollers;
3. from the centre of a 20" diameter roll draw a line inclined by 60-degrees from horizontal; then draw a line parallel to this 60-degree line and at a distance of, or offset by, 2.75". The intersection of this line with the forming roll pitch circle gives the centre of the forming roller at its outwardly extended position;
4. next, join the centres of a given forming roller for its starting and outwardly extended positions. Measuring the inclination angle of this travel line with respect to horizontal, and it will be 30-degrees.

The same exercise can be repeated for other roll diameters, and it will always be found to be a 30-degree inclination angle.

Figure 23:
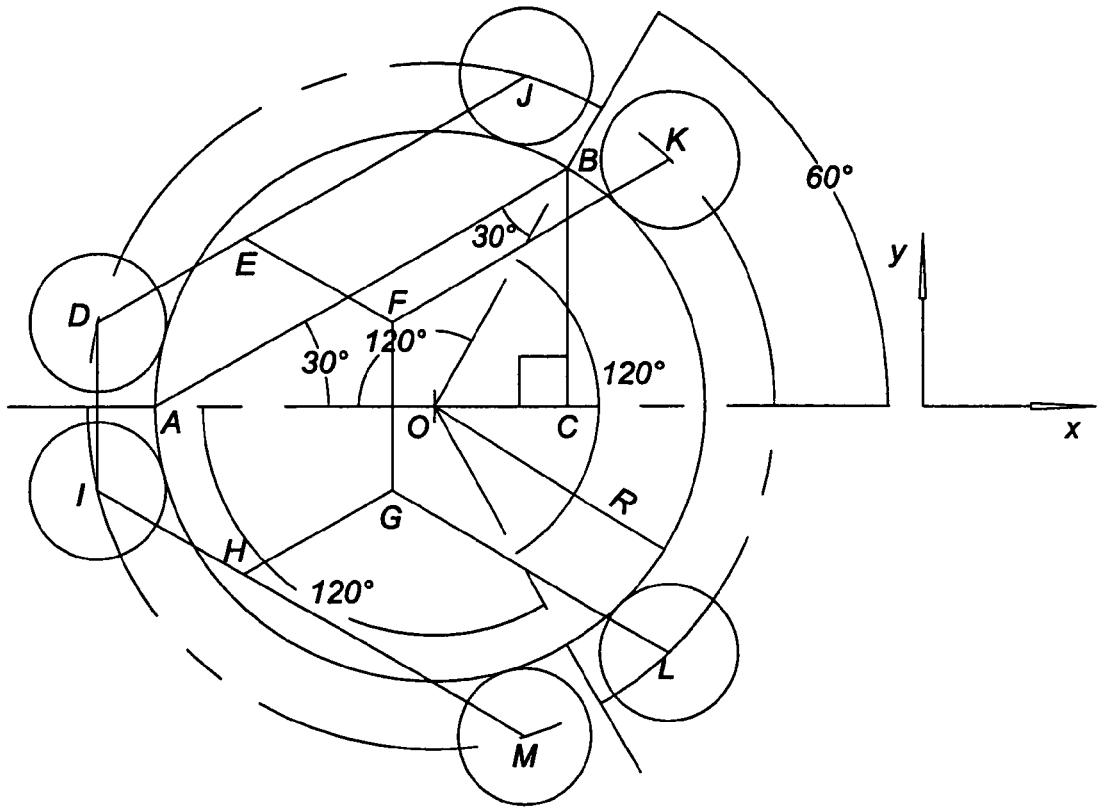
FIG. 23 presents a side elevation view of a fifth embodiment of the invention, showing how the optimal angle of travel for the four movable rollers can be calculated geometrically.

The same can be shown with respect to FIG. 23. Assuming a compressed roll of diameter r, and a desired angle of 120-degrees between continuous belt systems:

1. the displacement of forming rollers J and K, with respect to the stationary rollers D and I, in the Y direction, will be:

Y=r sin 60-degrees 2. the displacement of forming rollers J and K, with respect to the stationary rollers D and I, in the X direction, will be:

X=r+r cos 60-degrees 3. thus, the angle BAC that forming rollers J and K must follow to maintain this geometry, can be found as follows:

$$\tan(\text{angle } BAC) = (r \sin 60\text{-degrees})/(r + r \cos 60\text{-degrees})$$

$$\begin{aligned} BAC &= \tan^{-1}(r \sin 60\text{-degrees})/(r + r \cos 60\text{-degrees}) \\ &= \tan^{-1}(\sin 60\text{-degrees})/(1 + \cos 60\text{-degrees}) \\ &= \tan^{-1}(sqrt(3)/2)/(1 + 0.5) \\ &= 30\text{-degrees} \end{aligned}$$

Thus, if the moveable forming rollers follow paths that are 30-degrees to the horizontal, 120-degree symmetry will be maintained.

The same can be found using a trigonometric analysis, as follows:

The angle BAO in FIG. 23 is 120 degrees, similarly, the angle of BOC 60 degrees, as required by tri-fold forming rollers symmetry during the roll forming process. Thus:

$$OA = R;$$

$$OB = R;$$

$$R = \text{instant roll radius};$$

$$\begin{aligned} OC &= OB \cos(60 \text{ degrees}) \\ &= R \cos(60 \text{ degree}); \\ \text{AC} &= AO + OC = R + R\cos(60 \text{ degrees}) \\ &= R\,(1 + \cos(60 \text{ degrees})); \\ BC &= OB \sin(60 \text{ degrees}) \\ &= R \sin(60 \text{ degrees}) \end{aligned}$$

$$\begin{aligned} \tan(\text{angle } BAO) &= BC/\text{AC} \\ &= \frac{(R \sin(60 \text{ degrees}))}{(R(1 + \cos(60 \text{ degrees})))} \\ \text{angle } BAO &= (\tan^{-1}\sin(60 \text{ degrees})/(1 + \cos(60 \text{ degrees}))) \\ &= \tan^{-1}((sqrt(3)/2))/(1 + 0.5)) \\ &= 30 \text{ degrees} \end{aligned}$$

A simpler approach, based on geometry, proceeds as follows:

Since OA=R and OB=R, then triangle AOB is an isosceles triangle, meaning that the angles BAO and OBA are equal; the angle AOB is 120 degrees, then the angle BAO can be calculated as (180−120)/2=30 degrees. This approach seems to be much more straightforward. Similar logic or reasoning can be used to prove the case where the gap between forming rollers is taken into account:

Finding the optimal inclination angle of the forming rollers linear tracks when the gaps between the forming rollers are taken into account, is more complex. FIGS. 24A–24F present such an analysis.

Figure 24A:
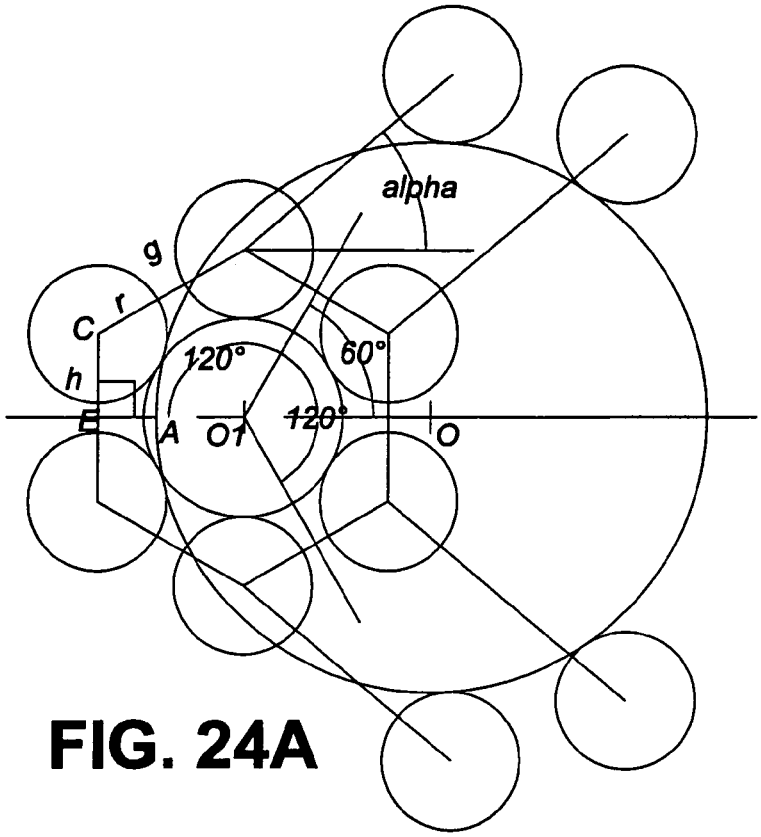
FIGS. 24A–24F present side elevation views of a fifth embodiment of the invention, showing how the optimal angle of travel for one of the four movable rollers can be calculated geometrically, taking into account gaps between adjacent rollers.
Figure 24B:
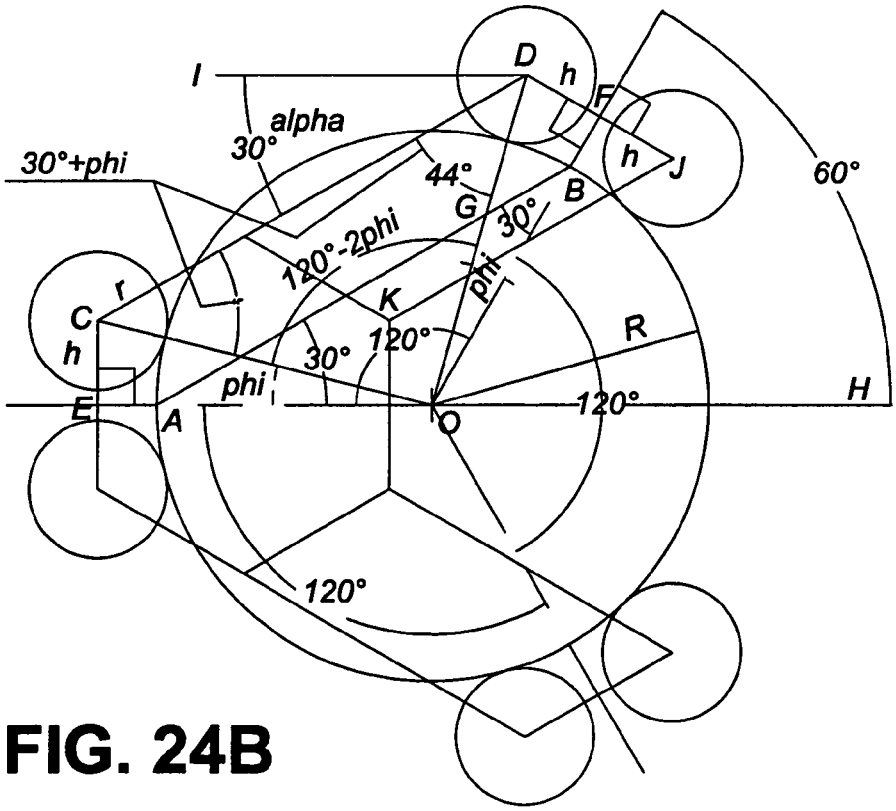

It has already been shown above (with respect to FIG. 23), that line AB is under the 30 degree angle with respect to the horizontal (as shown above with line OA). In FIG. 24A, we require that the perpendicular distance from a given forming roller center to its tri-fold symmetry line, denoted by h, is constant. In other words, therefore (see FIG. 24B):

$$CE = h;\ DF = h;\ \text{and } JF = h;$$

$$\begin{aligned} h &= (d + g)/2 \\ &= r + 0.5\ g \end{aligned}$$

$$CE = h;$$

$$CO = r + R;$$

Figure 24C:
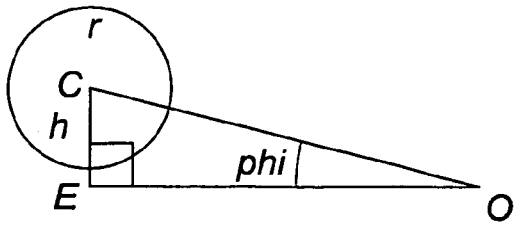
Figure 24D:
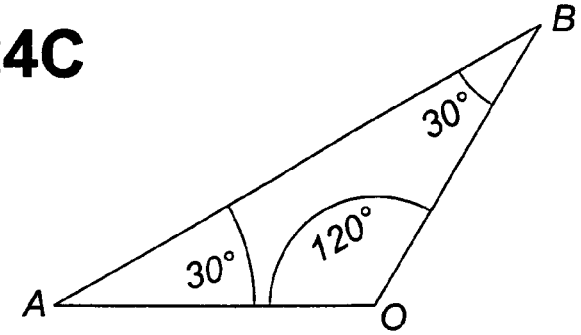
Figure 24E:
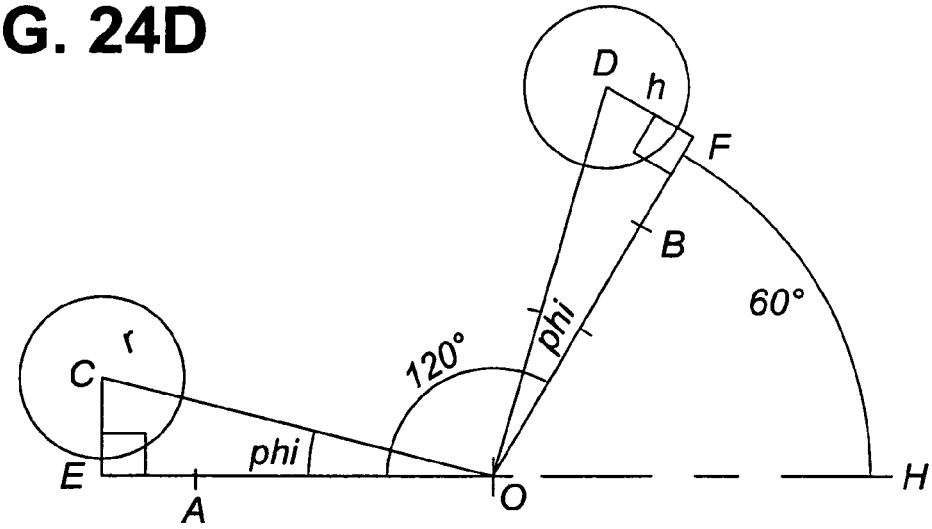
Figure 24F:
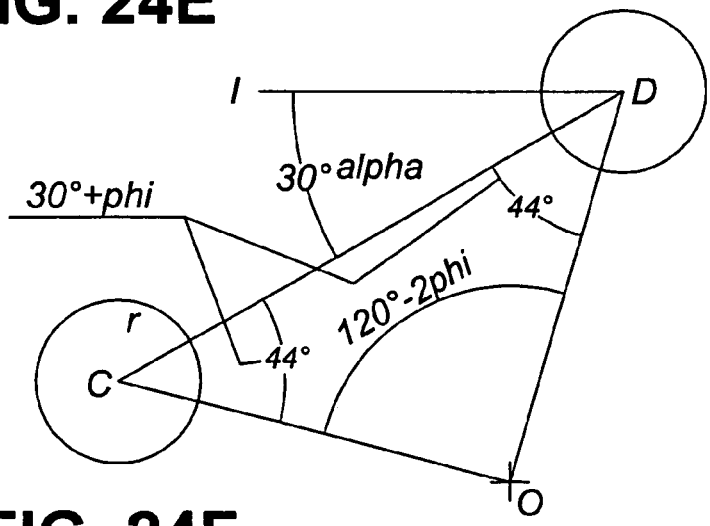

Let's call phi the angle COE in the right angle triangle CEO (see FIG. 24C). Since DF=h=CE, OD=r+R=OC, and triangle OFD is also a right angled triangle, both of triangles OFD and CEO are the same. Therefore, the angle DOF is also phi, being equal to the angle COE. Triangle COD is an equilateral triangle (OD=r+R=OC), and its angle COD is (120−2 phi) degrees (see FIGS. 24D and 24E). Then, the angle CDO is equal to: angle CDO=(180−(120−2 phi))/2=(30+phi) degrees. Angles ODI and HOD are equal since their sides are parallel to each other; ID parallel to OH, since both are horizontal; OD is common for both angles (see FIG. 24F):

angle ODI=angle ODC+angle CDI;
angle ODC=30+phi;
angle CDI=alpha;
angle ODI=(30+phi)+alpha;
angle HOD=angle HOF+angle FOD;
angle HOF=60;
angle FOD=phi;
angle HOD=60+phi;
angle ODI=angle HOD;
(30+phi)+alpha=60+phi; and
alpha=30 degrees;

this proves that the inclination angle of the linear track CD has to be 30 degrees to assure the full symmetry of the roll forming process.

Figure 25A:
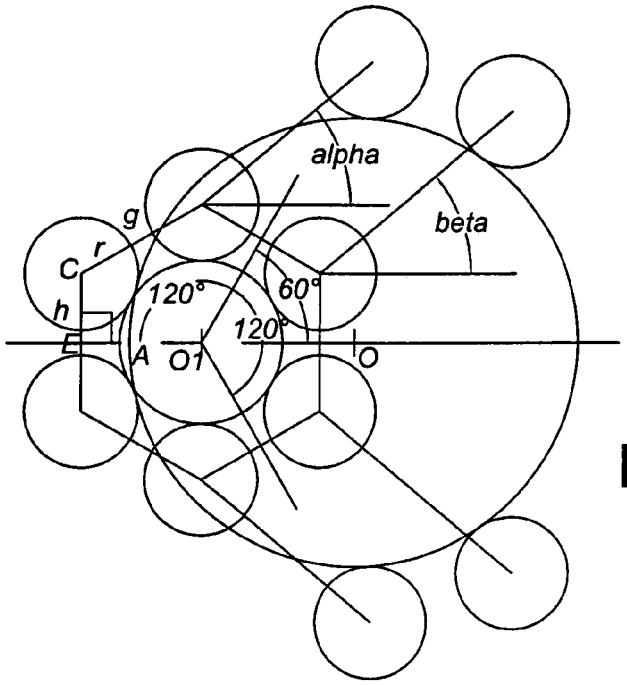
FIGS. 25A and 25B present side elevation views of a fifth embodiment of the invention, showing how the optimal angle of travel for a second one of the four movable rollers can be calculated geometrically, taking into account gaps between adjacent rollers.
Figure 25B:
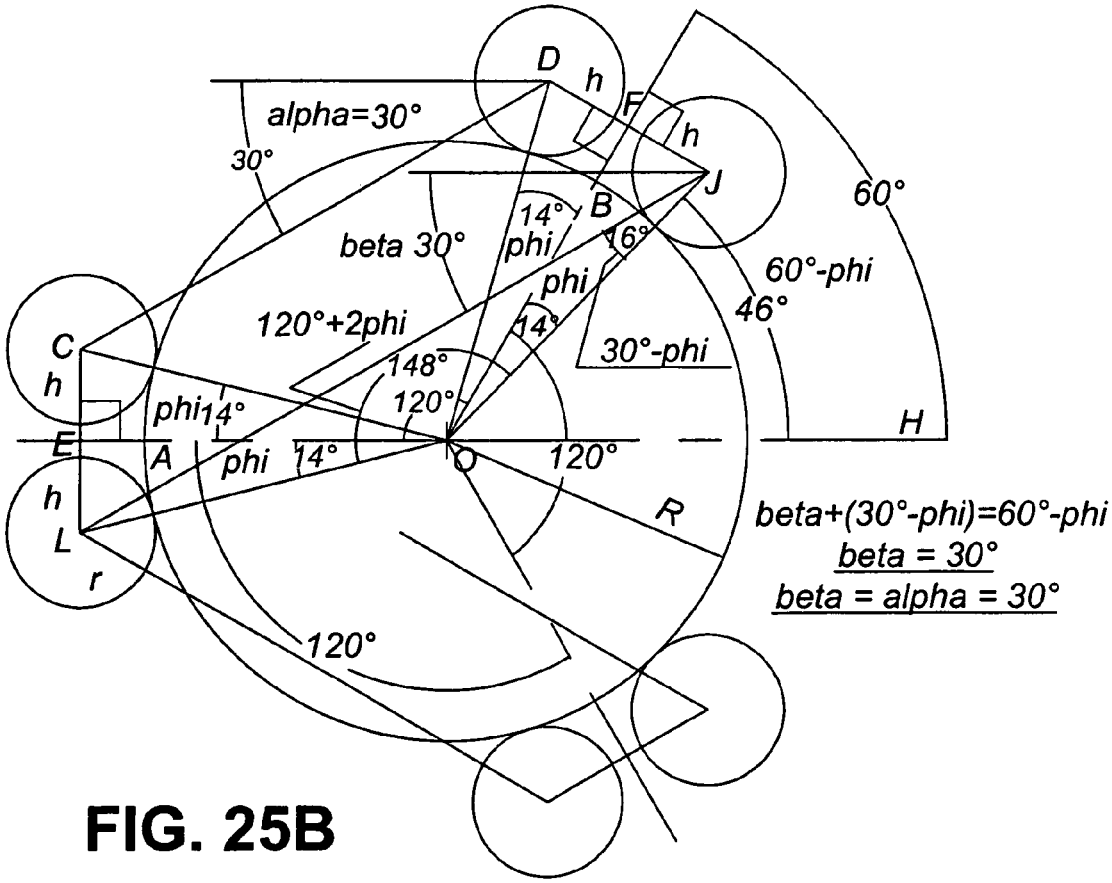

Similarly, one can prove that the optimal inclination angle for the linear track JL also has to be 30 degrees (see FIGS. 25A and 25B). Considerations have been made with respect to the bottom forming roller at the product entry—this roller is fixed in space. Both tracks DC and JL are therefore parallel. Line JL passes through the point K, shown in FIG. 25B, which is the starting position of the roller under consideration. Forming rollers starting configuration is a regular hexagon; KJ length of the line JL is the actual linear track. Neighbouring forming rollers move along parallel tracks, inclined 30 degrees with respect to the horizontal, and with the same speed as they travel equal distances over a given period of time Note that this analysis in FIGS. 25A and 25B does take into account the gap between forming rollers.

With 30-degree inclination on the forming roller tracks, full symmetry can be maintained on the continuous belts, over the whole process of roll forming. As well, only one control program is needed for forming rollers positioning as adjacent forming rollers can move together, maintaining the fixed gap between them as they extend outwardly during their travel.

This 30-degree roll-up design meets all the criteria of practical importance, and as such, is the preferred choice.

Figure 26:
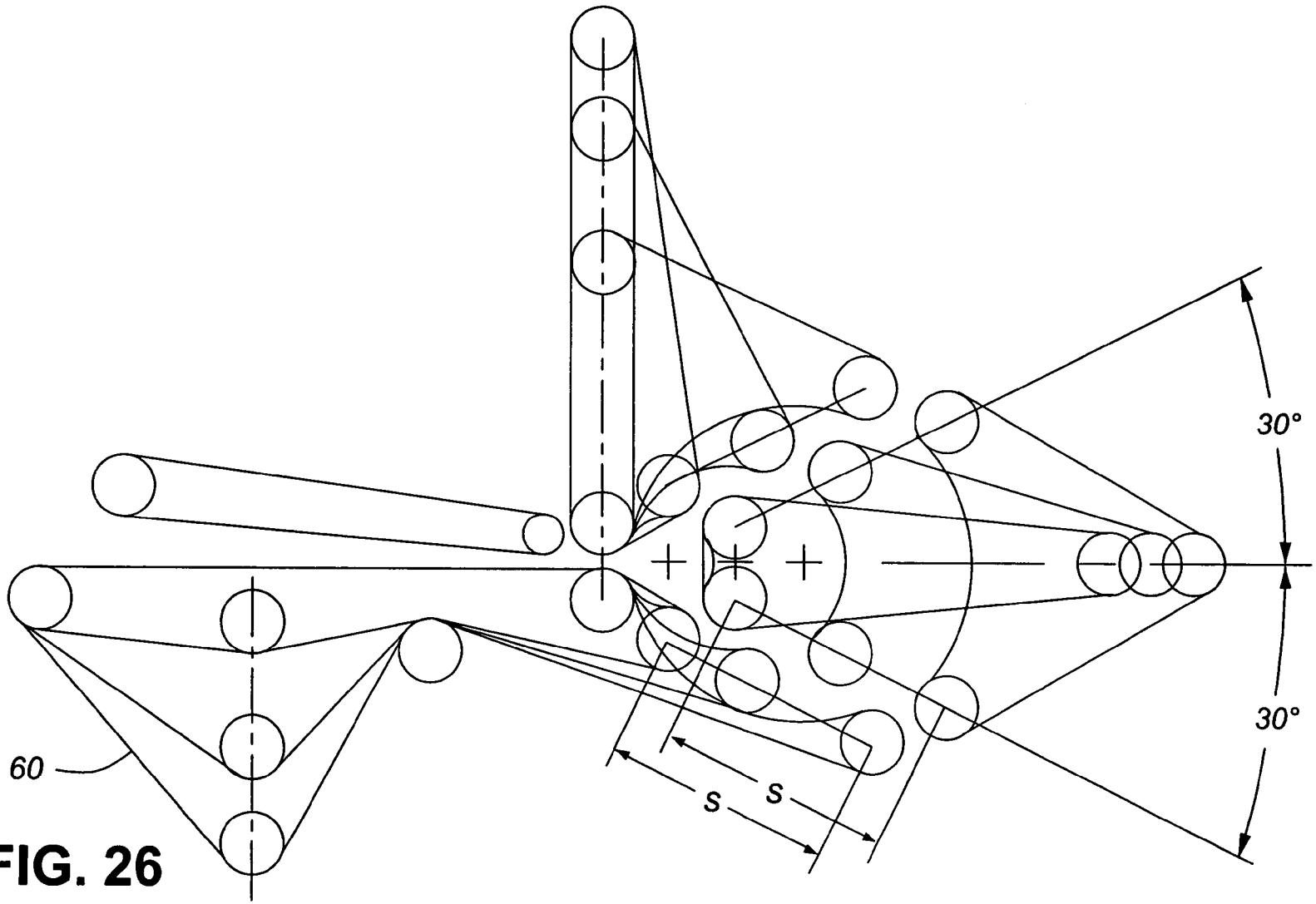
FIG. 26 presents a side elevation view of a fifth embodiment of the invention, in which the bottom feed conveyor is integrated with the bottom roll forming belt segment.

The belt roll-up conceptual design, having an optimal, 30-degree linear track inclination angle, is shown in FIG. 26. The basic fact that all the rollers travel the same distance in the same period of time, is emphasized by giving the two "s" dimensions. The bottom transfer conveyor 60 of the pre-compression belt conveyor system is shown here integrated with the bottom roll forming belt segment, leaving, therefore, no gap between them, which may prove advantageous.

The geometry of this belt roll-up machine constitutes the most refined design form, offering most of the practical benefits, and still being relatively simple, and inexpensive. The partial list of positive features attributed to this belt roll-up design includes:

1. a stationary roll-up machine and pre-compression belt conveyor system, therefore requiring neither any retracting mechanism nor any associated control system;
2. a generally full, 360-degree belt enveloping geometry, rather than a three- or four-point contact roll winding configuration;
3. capacity for high compression ratios;
4. utility in both single-stage or a two-stage compression processes, the same control program being easily suited for either application;
5. no gap between the bottom transfer conveyor 60 of the pre-compression system and the bottom, roll forming belt segment;
6. the roll forming process retaining its full symmetry all the time;
7. each belt segment contributing equally, thus, having the same belt tension and take-up travel for each belt segment;
8. the take-up length needed for each belt segment being far less than that required for the single-belt and two-belt loop roll-up designs;
9. there is a stationary feed point defined by two stationary forming rollers;
10. only four forming rollers moving outwards, not six;
11. just one control program for rollers positioning is needed, and this program is simple, short, straightforward, based on reliable and fully verifiable assumptions;
12. the same control program can handle either single-stage or a two-stage processes;
13. the roll ejection stage is gradual and rather smooth, not calling for a rapid and drastic change in the belt geometry which can affect belt tracking;
14. the use of six, sufficiently stiff and symmetrically distributed forming rollers, avoids the drawbacks experienced with the free-loop designs, such as telescoping; and
15. this design can roll batts as well as lengths of material, without any supporting continuous sheet material.

The above mentioned advantages are not particularly given in the order of their relative importance.

Figure 27A:
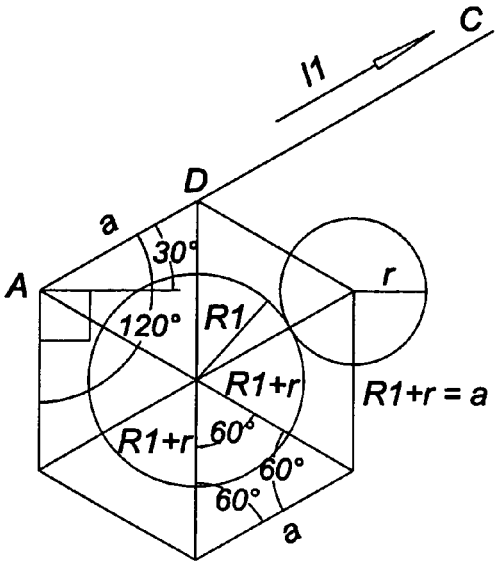
FIGS. 27A–27C present side elevation views of a fifth embodiment of the invention, showing how the control algorithm for the travel of the rollers is to be derived.
Figure 27B:
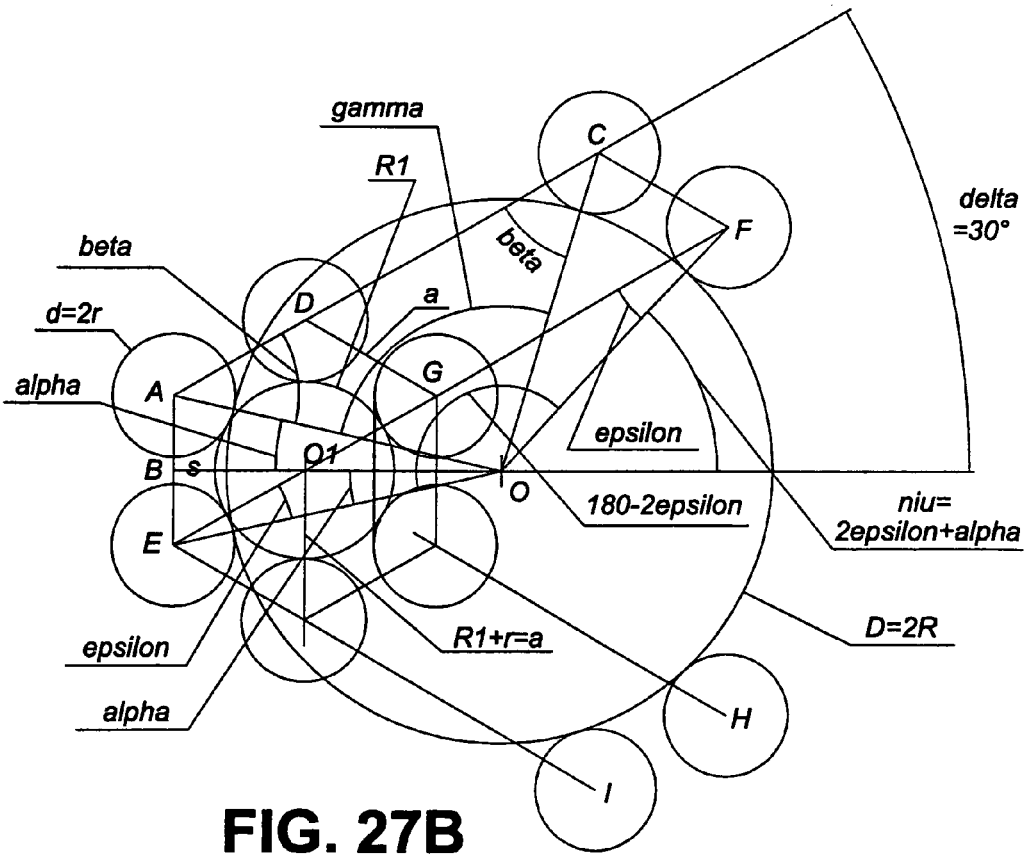
Figure 27C:
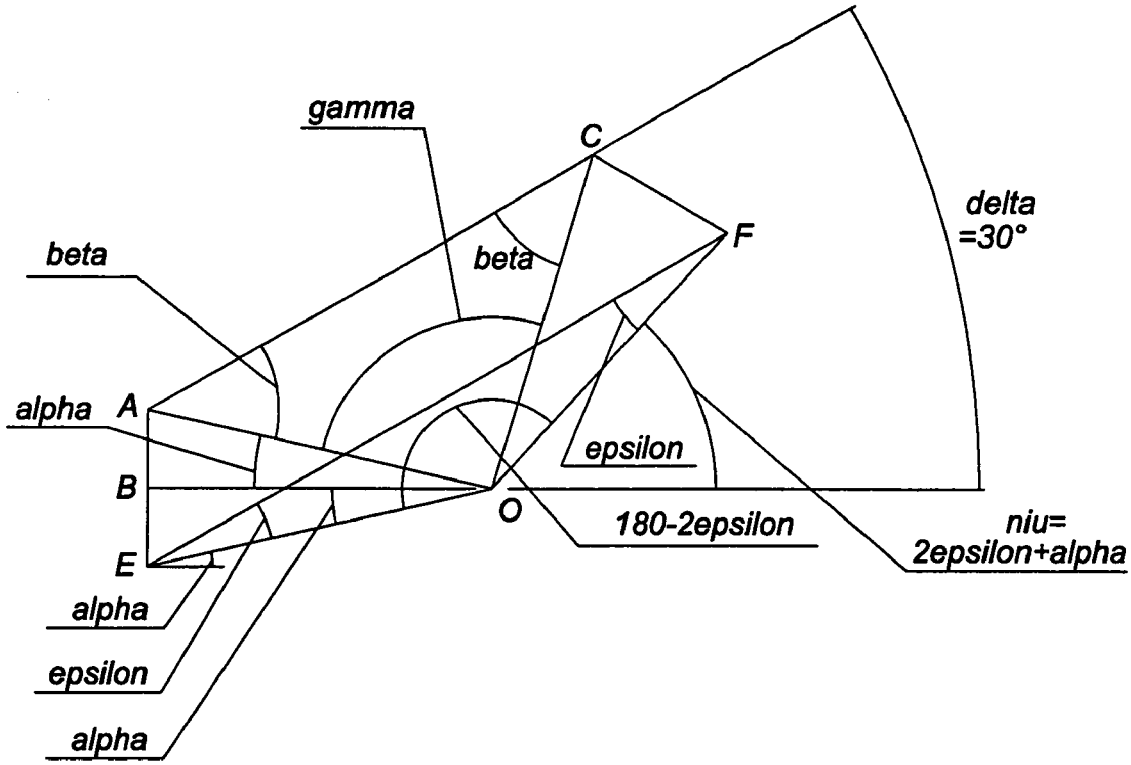

FIGS. 27A–27C provide sketches used for deriving the control algorithm for the belt roll-up machine with 30-degree inclined forming roller tracks, FIG. 27A presenting the starting position, FIG. 27B presenting an arbitrary middle position, and FIG. 27C presenting a detail of the geometry.

Design parameters include the forming roller diameter d=2r (r-forming roller radius), the gap between forming rollers s, and the actual or instant roll diameter R where the roller diameter d (radius r) and the gap s are fixed, while the roll diameter R is variable. What is to be found is the forming roller position, expressed as a distance 11 from its starting position, where forming rollers are evenly spaced about a circle in the starting configuration.

Referring to FIGS. 27A–27C note that:

$$d = 2r;$$

$$a = d + s;$$

$$r = d/2;$$

$$\text{alpha} = \arcsin(a/2(R+r)));$$

$$\text{beta} = 30 + \text{alpha};$$

$$\text{AC} = 2(R+r)\cos(\text{beta})$$

$$I_1 = \text{AC} - AD = \text{AC} - a;$$

$$\text{gamma} = 180 - 2\ \text{beta};$$

$$\text{delta} = 30;$$

$$\text{epsilon} = 30 - \text{alpha};$$

$$niu = 2\ \text{epsilon} + \text{alpha};$$

$$\begin{aligned}\text{angle } AOC &= \text{angle } EOI \\ &= \text{gamma} \\ &= 180 - 2 * \text{beta} \\ &= 180 - 2 * (30 + \text{alpha}) \\ &= 120 - 2 * \text{alpha; and}\end{aligned}$$

$$\begin{aligned}\text{angle } FOH &= 2 * (2 * \text{epsilon} + \text{alpha}) \\ &= 4 * \text{epsilon} + 2 * \text{alpha} \\ &= 4 * (30 - \text{alpha}) + 2 * \text{alpha} \\ &= 120 - 2 * \text{alpha}\end{aligned}$$

The above calculations are not needed at all for finding the position of forming rollers for a given roll radius R, but they do show that the angle of contact for each belt segment is always the same. Thus, full symmetry is always retained during the roll forming process (i.e. angles AOC, EOI and FOH are always equal).

Forming roller positioning (a 30-degree case) procedure:

Enter:
- forming roller diameter d [inch]
- forming roller gap s [inch]
- product roll diameter D [inch]

Calculate:
- forming roller radius r=(d/2)[inch]
- product roll radius R=(D/2)[inch]
- a=d+s [inch]
- alpha=arcsin(a/(2(R+r))); alpha [deg]
- beta=30+alpha; beta [deg]
- $i_1$=2 (R+r)cos(beta)−a The complete control algorithm for positioning forming rollers for 30-degree inclined tracks belt roll-up machine is as follows:

Data Section
- product nominal thickness $th_n$ [inch]
- product actual thickness th [inch]
- product length L [ft]
- roll diameter D [inch]
- roll-up (winding) speed $v_w$ [ft/min]
- forming roller diameter d [inch]
- forming roller gap s [inch]

Processing Section roll radius R=(D/2) [inch]

average nominal compression ratio $CR_n$ [−]

$CR_n=(12*th_n*L)/(\pi*R^2)$ (metric system: $CR_n=(th_n*L)/(\pi*R^2)$)

average actual compression ratio CR [−]

$CR=(th_n/th)*CR_n$ a pre-compression belt conveyor system setting;

minimum exit gap thickness $th_{nc}$ [inch]

$th_{nc}=th_n/CR_n$ elapsed time t [s]

material length L(t) being already rolled-up at the time instant t $L(t)=v_w*(t/60)$ [ft]

(metric system: $L(t)=v_w*t$)

roll radius R(t) as a function of material winding time $R(t)=sqrt((12*th_n*v_w*t)/(60*\pi*CR_n))$ [inch]

(metric system: $R(t)=sqrt((th_n*v_w*t)/(\pi*CR_n)))$ forming roller radius r=(d/2) [inch]

a=d+s [inch]

alpha(t)=arcsin(a/(2(R(t)+r))); alpha(t) [deg]

beta(t)=30+alpha(t); beta(t) [deg]

forming roller position $l_1(t)$ $l_1(t)=2(R(t)+r)cos(beta(t))-a$; $l_1(t)$ [inch]

total roll winding time $t_{tot}$ $t_{tot}=(60*L)/v_w$; $t_{tot}$ [s]

(metric system: $t_{tot}=L/v_w$)

The same control algorithm applies regardless of whether full or only partial material compression has been done at the pre-compression stage.

Similar calculations can be performed for any arbitrary inclination angle, though the procedure may become much more involved and lengthy than for the optimal 30-degree case. Also, when an angle other than 30-degrees is used, there are generally two different control curves required for adjacent forming rollers, belonging to neighbouring belt segments if any angle other than 30-degrees is used.

FIG. 28 provides a summary of the control parameters for implementations of the invention using forming roller linear track angles in increments of 5-degrees from 15-degrees to 45-degrees. It once again confirms the earlier finding that the 30-degree inclination angle is the optimal one, assuring full symmetry in the roll forming process (all belt segments contribute equally, as indicated by their contact angles), and requiring a single control program for positioning all forming rollers along their inclined linear tracks. The further one departs from the optimal 30-degree angle, the greater the discrepancy in the contact angles for different belt segments. This, in turn, calls for different belt tensioning and take-up lengths for different belt segments, not particularly welcomed from the design and operational points of view. Two forming roller control programs are needed and the programs are more involved than for the 30-degree case, because of the unequal travel distances 1 and 12, and the gap between forming rollers not being constant.

The preferred embodiment of the invention incorporates three continuous belts to define a circular cavity, but clearly, other aspects of the invention such as the tensioning and take up systems can also be applied to other roll-up machines.

Figure 29A:
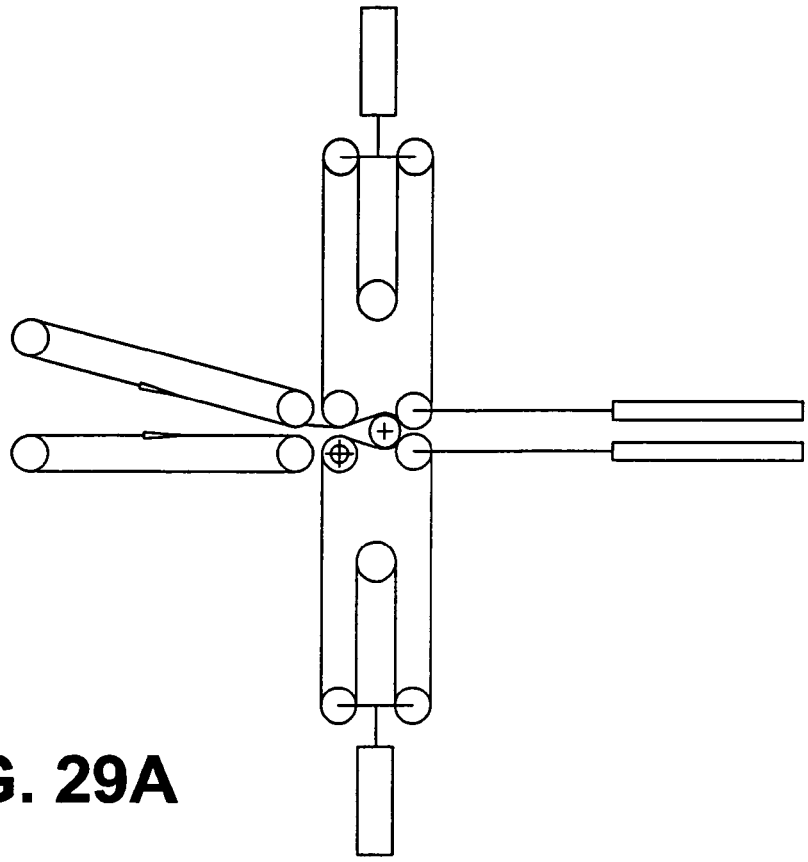
FIGS. 29A through 29C present the application of certain aspects of the invention to two-belt roll-up machines.
Figure 29B:
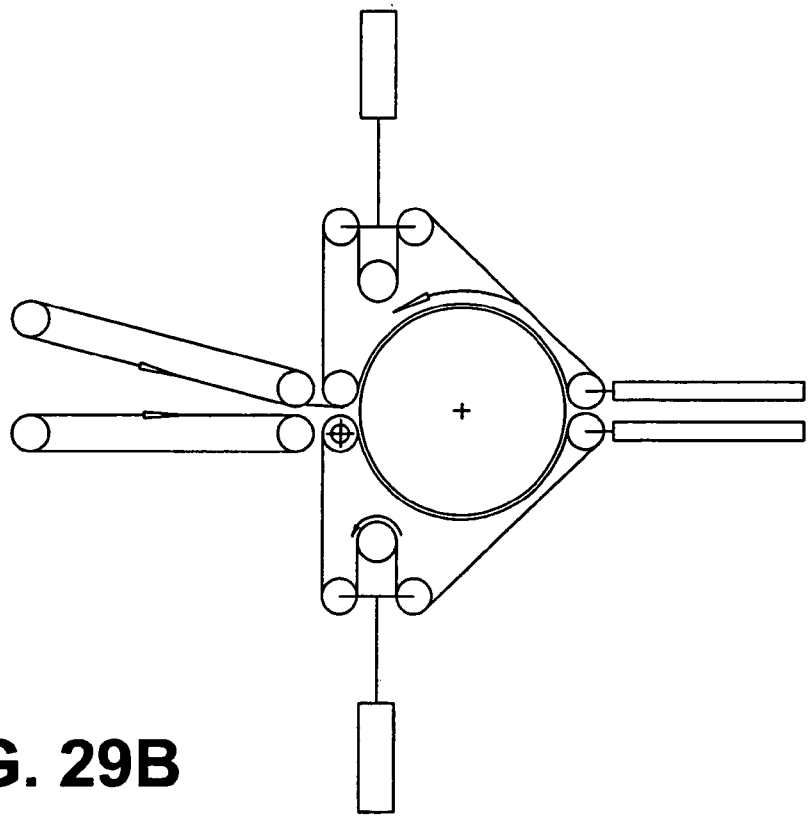
Figure 29C:
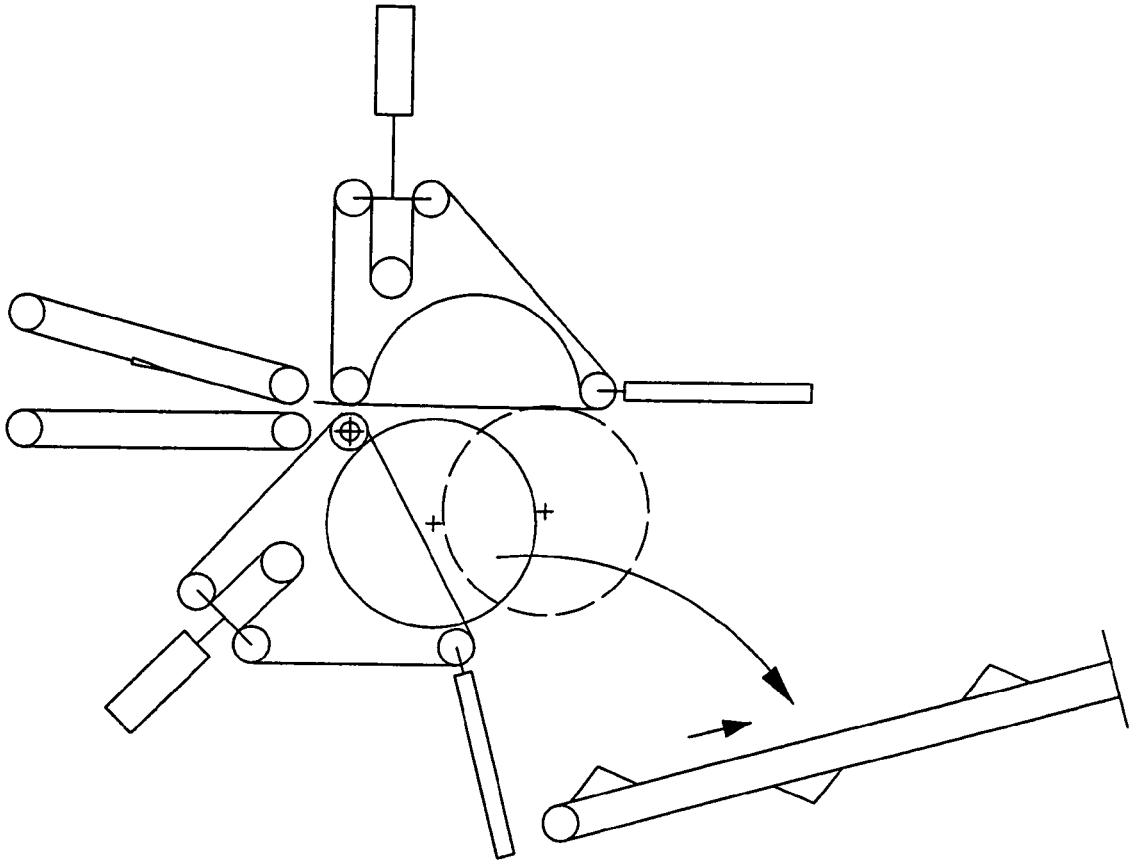
Figure 30:
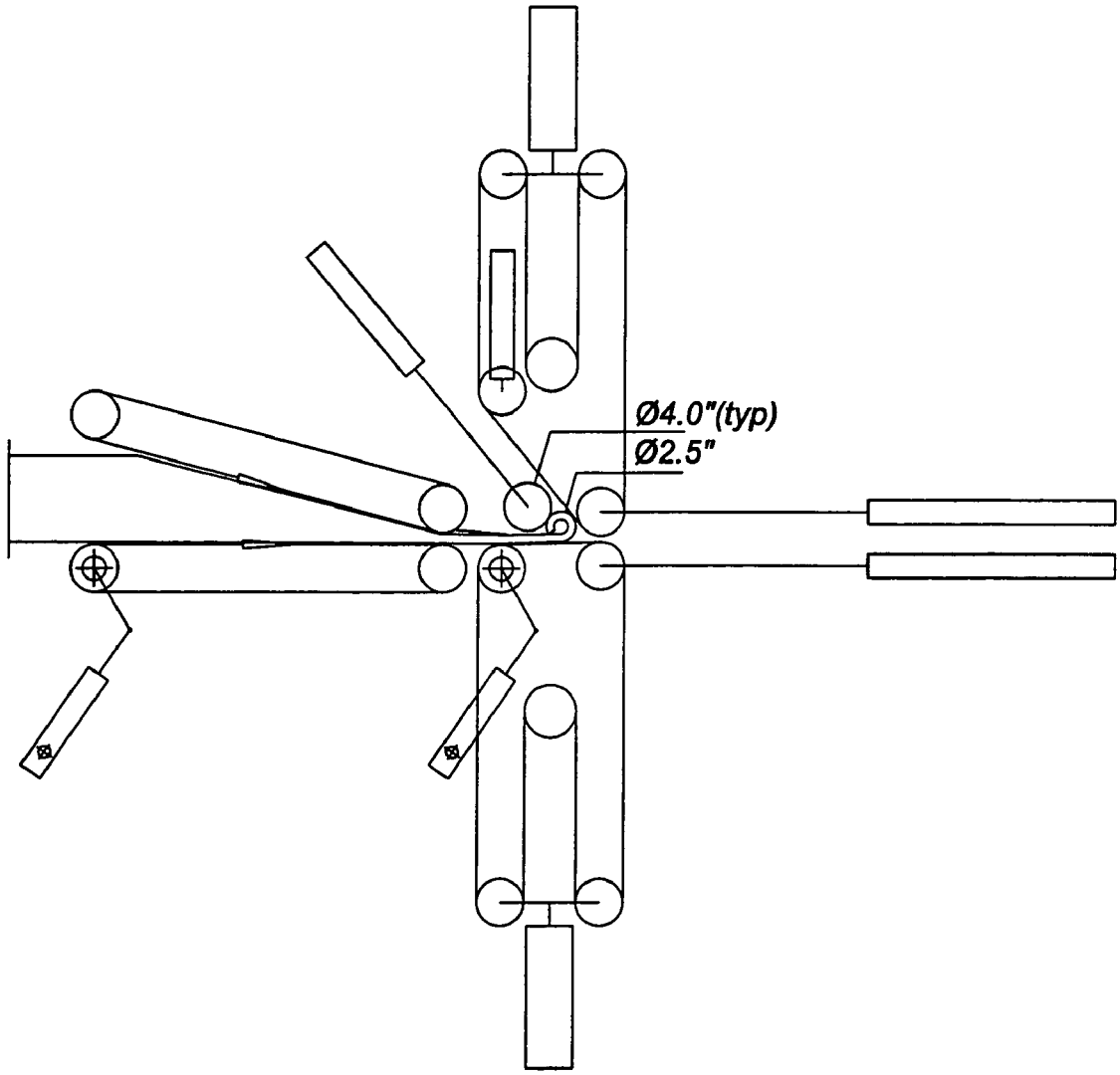
FIGS. 30–33 present schematically an operational sequence of another version of the two-belt roll-up machine, where two auxiliary pneumatic cylinders are added to help during the roll start-up.
Figure 31:
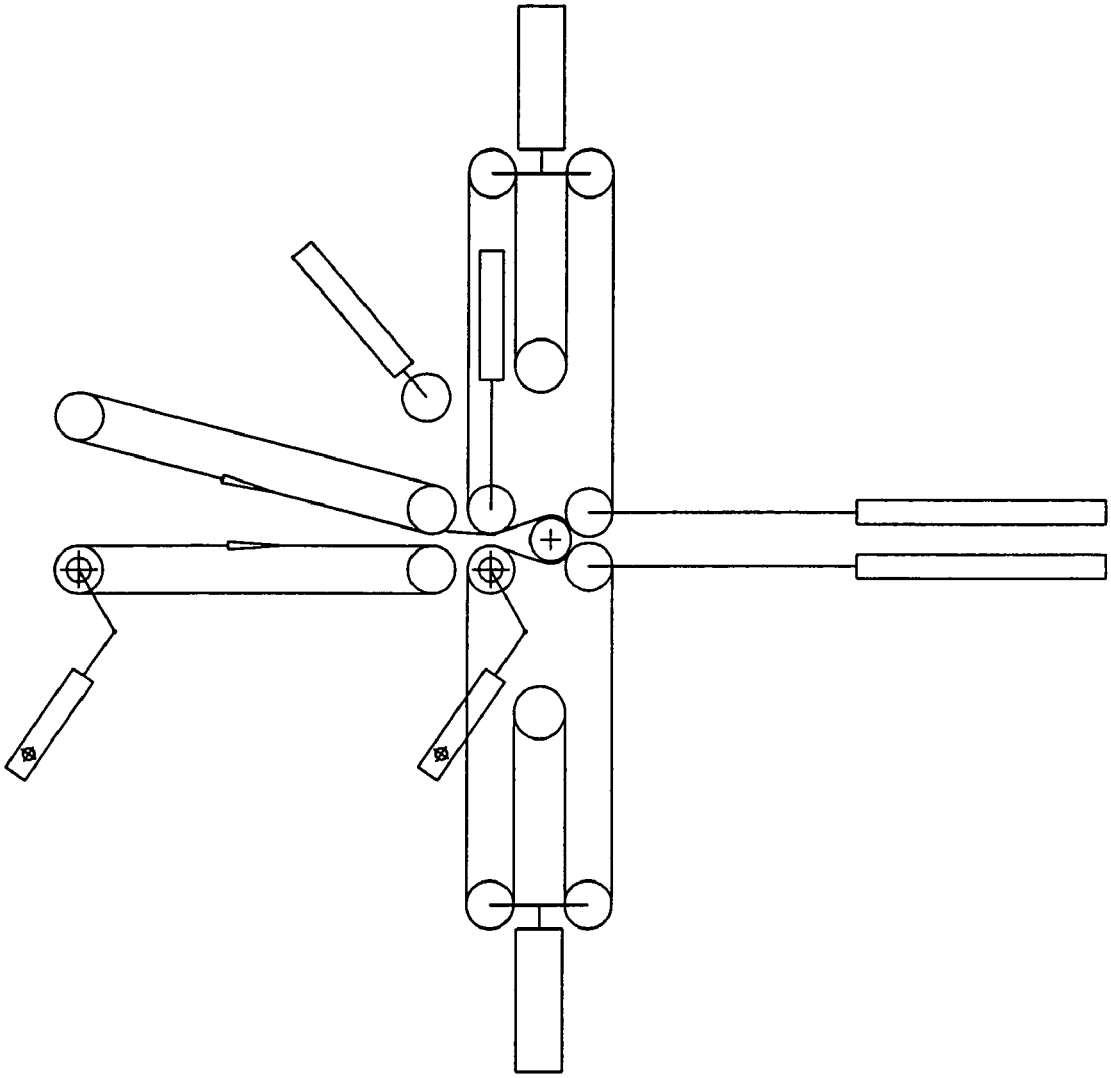

FIGS. 29A through 29C, for example, present the application of certain aspects of the invention to two-belt roll-up machines. The entry zone forming rollers, as well as the pre-compression belt conveyor device, are stationary, as is the whole roll-up machine. Preferably, there is some taper added to the initial belt configuration, so the straight line lengths of belts between the front and back forming rollers are not parallel to each other, easing the roll start-up process. The back forming rollers move along the horizontal linear paths in the backward direction; this is a controlled travel, executed by the hydraulic cylinders. The take-up system is shown to be a pneumatic cylinder activated, double-pulley assembly, to reduce the required cylinder stroke by a factor of two; keeping the roll of product under the same compression all the time. As the roll diameter grows, the air cylinder pressure should be gradually increased, according to some pre-programmed function. Roll ejection is effected by swinging the bottom belt conveyor downward. Before ejecting, the rolled product is wrapped with plastic sheet or kraft paper, and the wrapped roll is sent for further processing (inclined belt conveyor with some holding attachments is shown, but clearly there are many other design possibilities).

While aspects of the invention can be applied to two-belt roll-up machines, such machines are still inferior to the three-belt design. For example, efficient startup of a two-belt machine still requires an extra mechanical system, which adds complexity, cost and inconvenience, and reduces reliability of the system.

Figure 32:
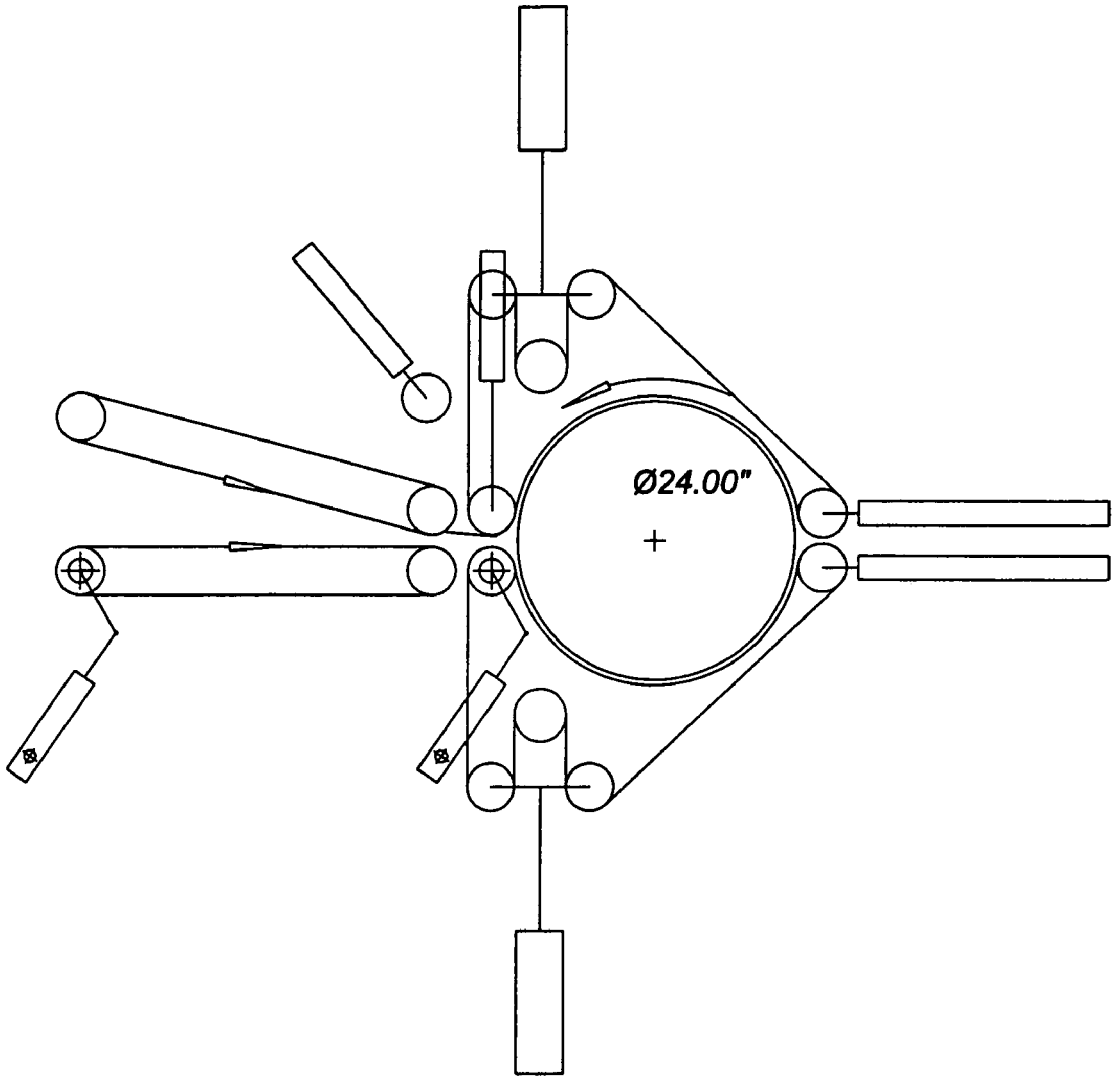

FIGS. 30 to 33 show schematically an operational sequence of another version of the two-belt roll-up machine, where two auxiliary pneumatic cylinders are added to help during the roll start-up. The inclined pneumatic cylinder, fully extended during the start-up, causes the roller it is acting upon to close the triangular winding space sufficiently tightly, so the compressed material has to curve along some restricted circular path, thus, starting the roll of compressible product. When enough material has already been fed to make the roll core a certain thing, the inclined cylinder quickly retracts along a path parallel to the inclined stretch of the top belt conveyor, and then, the top pneumatic cylinder quickly pushes its forming roller down to close the roll forming space. This situation is illustrated in FIG. 32. The front forming rollers are stationary, while the two back forming rollers gradually move back, in a fully controlled fashion, acted upon by a hydraulic cylinders. The tensioning and take-up mechanism is based on pneumatic cylinders with pre-programmed control of the air cylinder pressure, increasing with time, as the roll diameter grows. A double-pulley assembly is used to reduce the required stroke of pneumatic cylinder and a larger diameter air cylinder used to give the high pulling force. The highest pulling force for the final diameter roll being approximately four times the required belt tension.

Figure 33:
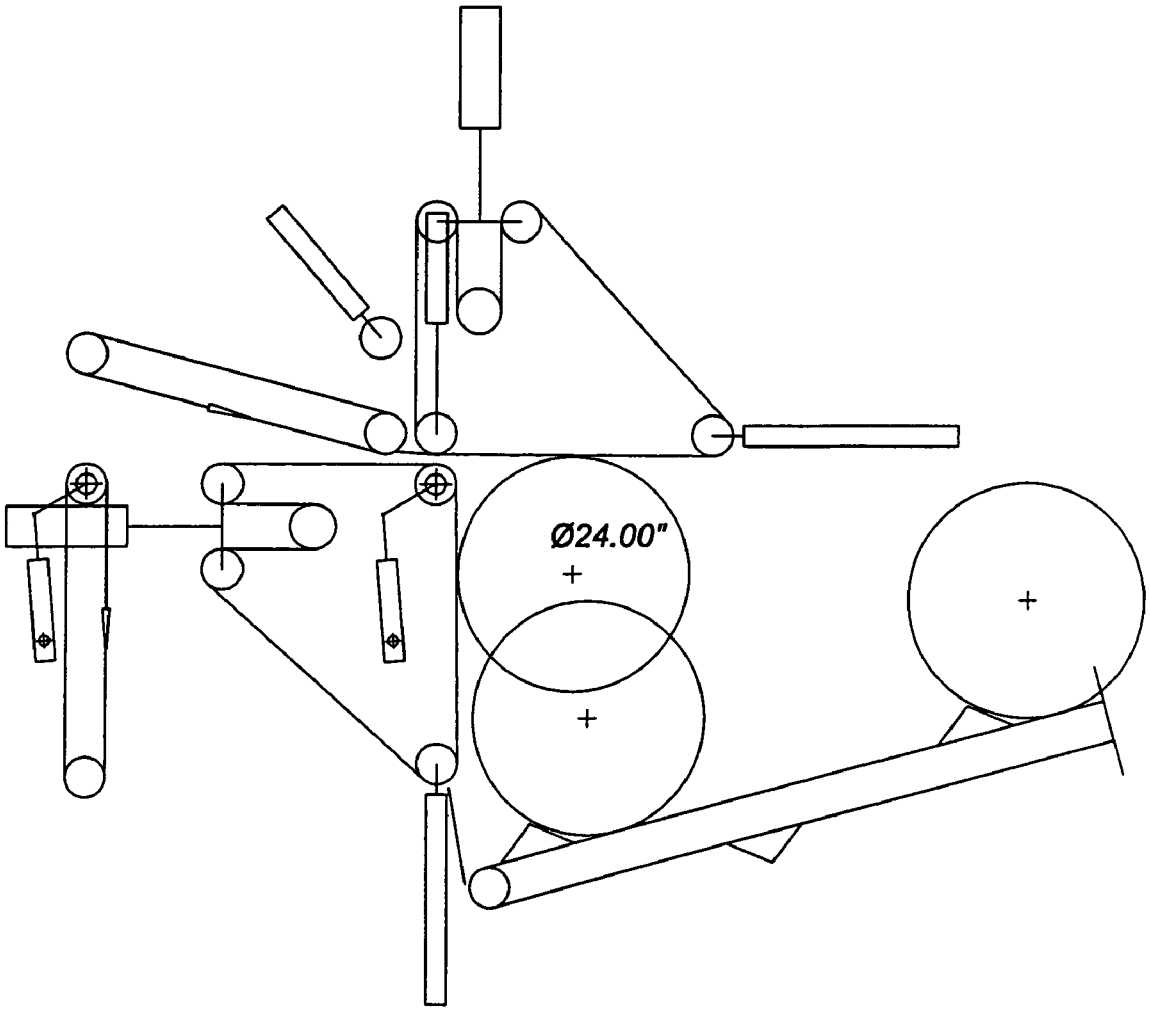

Roll ejection, after wrapping the compressed roll with sheet material, is done by swinging the bottom belt conveyor assembly clockwise by approximately 90 degrees as shown in FIG. 33. The compressed roll is then ejected with the assistance of gravity and the belts which will straighten-up. Note that it may also be necessary to rotate the bottom conveyor assembly as well, in sync or with some lead time, to avoid the compressed roll as it is being ejected.

Belt Tension

If one accepts the logic that the contact pressure exerted by the belt on the roll of material, that is, the radial compressive stress on the roll outside surface, has to be the same all the time, regardless of the roll diameter, it inevitably implies that the belt tension has to be gradually increased, as the roll grows in its size.

Figure 34A:
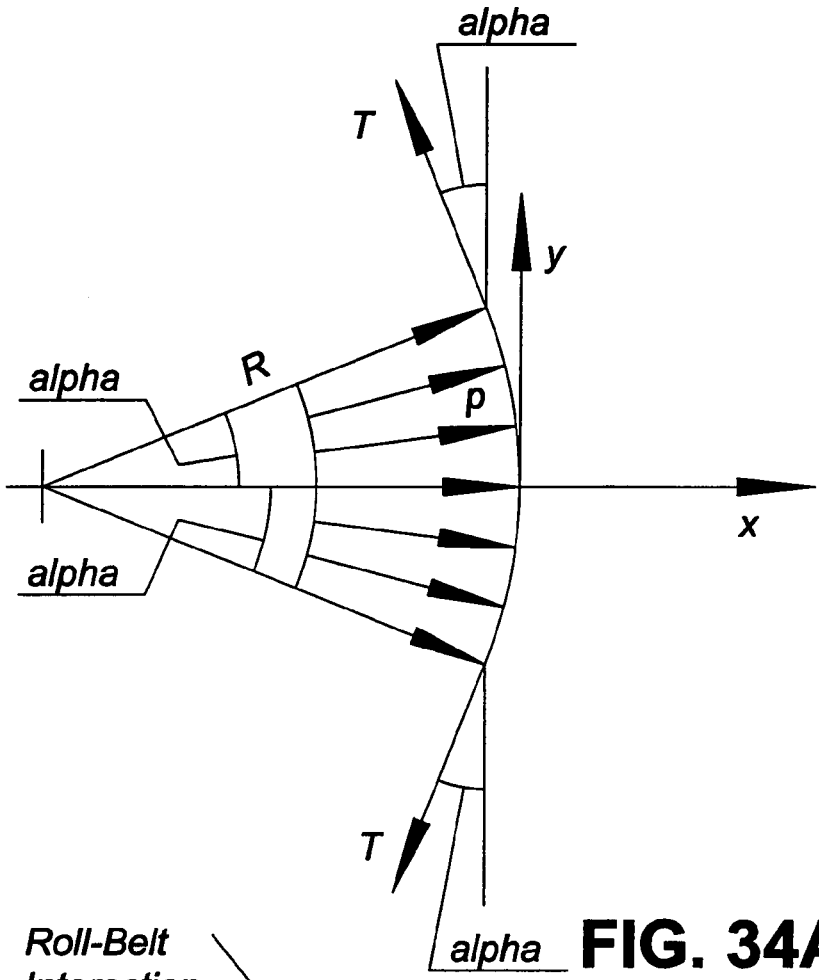
FIGS. 34A and 34B present layouts of an embodiment of the invention for the purposes of calculating belt tension.
Figure 34B:
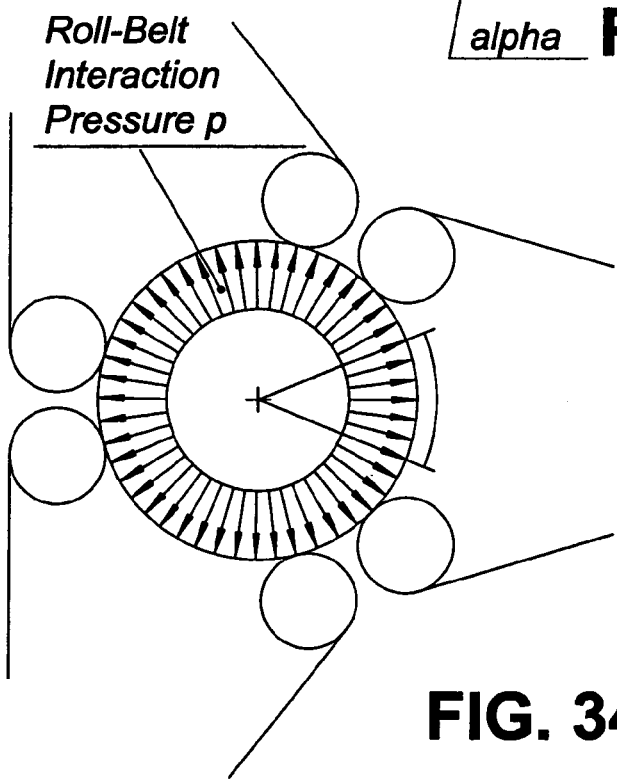

FIGS. 34A and 34B present a graphic layout of the forces on the belts of the invention. Without taking into account frictional or inertial effects associated with the dynamics of the roll forming process, the x-direction force may be calculated as follows:

b=belt width (m);

p=roll belt interaction pressure ($N/m^2$);

R=roll radius (m);

T=belt tension (N);

2 pbR sin(alpha)=2T sin(alpha);

T=pbR;

Thus, to maintain constant pressure p, and in view of b being constant, we obtain:

T~R, T=kR, k=constant

Basically, the increase in the belt tension has to be proportional to the roll diameter. Whether this is true in real applications is difficult to predict. The relationship or function does not necessarily have to be linear, but can be curvilinear as well. Regardless, the belt tension certainly must increase with the roll diameter and not remain constant.

Figure 35:
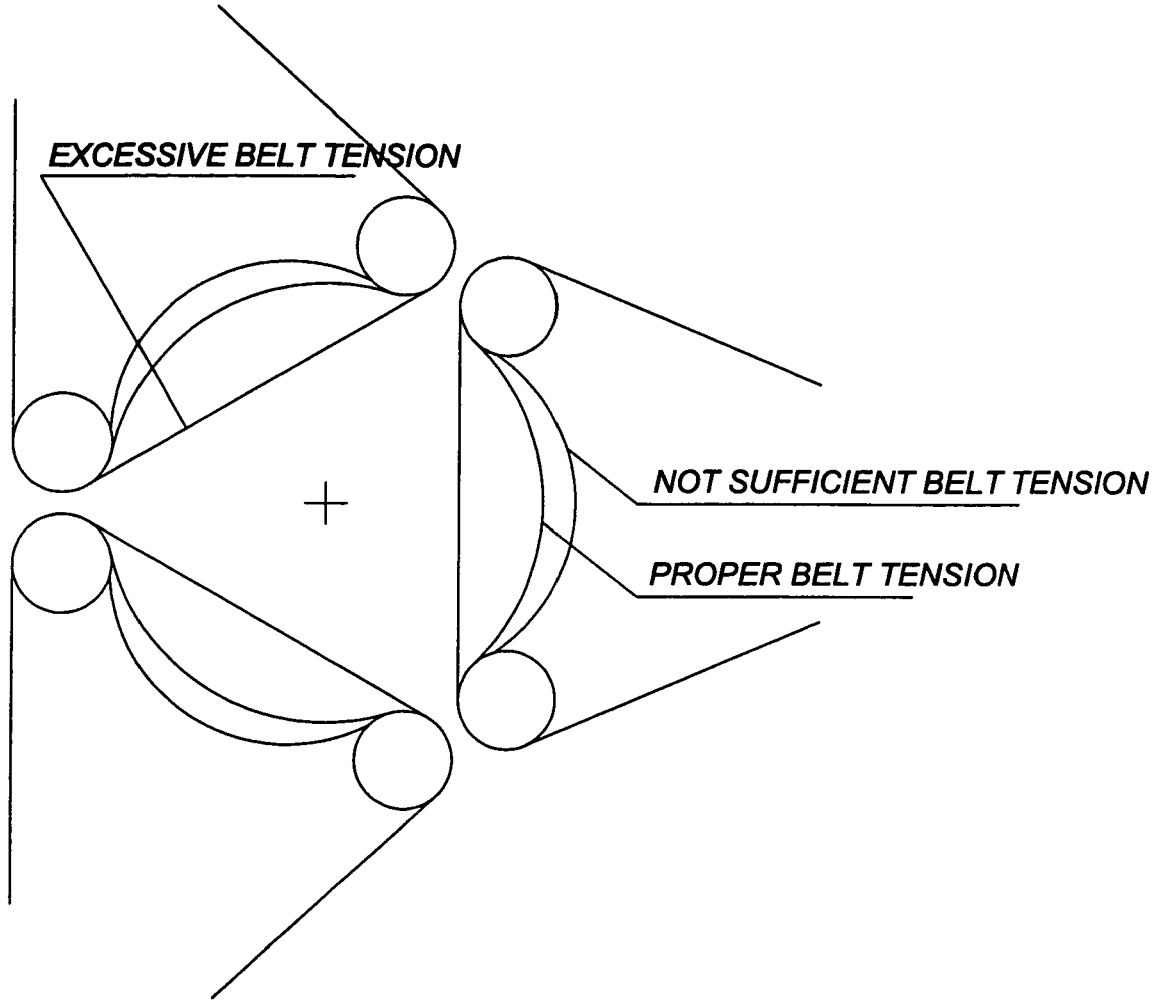
FIG. 35 presents a graphic representation of the impact of under- and over-tension on the compressed roll.

FIG. 35 depicts the interaction between the belt under tension and the highly compressed roll, depending on the actual degree of belt tension. If the belts are two tense, the compressed roll will be damaged by compression/decompression cycling because the belts will form a generally triangular cavity. If the belts are not tense enough, the arcs formed between the forming rollers will have radii that are less than the radius required for a circular cavity. As a result, the compressed roll will again be damaged by compression/decompression cycling as the greatest compression will be effected by the forming rollers themselves.

The situation as presented in FIG. 35 is largely exaggerated, and will generally only occur when the take-up system is a mechanical spring or pneumatic cylinder activated, in other words, the take-up pulley is free to move depending on the resultant force acting on it.

The situation is different when the take-up system is equipped with a hydraulic cylinder. What is directly set in this case is the take-up pulley position, not the belt force as such. For the hydraulic cylinder based take-up system, FIG. 35 should be interpreted as showing the deviations in the take-up pulley positioning, and the resulting shape of the belt, for a given position of the forming rollers. If it is desirable that the roll take on a circular shape and diameter, with a given compression ratio, at a particular point, it can clearly be determined where the forming rollers should be, and what the exact shape of the belt stretch between them should be. In consequence, the position of the take-up pulley is established.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A roll-up machine for rolling up a compressible material comprising:

three continuous belts defining a circular cavity and establishing generally circumferential contact with said compressible material so that said compressible material is under compressive pressure as it is being rolled;

each of said three continuous belts providing only a portion of the circumference of said circular cavity;

means for putting said three continuous belts under a desired level of tension;

means for driving said three continuous belts to rotate said compressible material within said circular cavity;

six sufficiently stiff forming rollers, two for each of said three continuous belts, for defining said circular cavity;

means for coordinating the positions of said six forming rollers, to maintain the shape of said circular cavity as said compressible material is fed into said circular cavity; and means for feeding said compressible material into said circular cavity through an entry zone between forming rollers of two of said three continuous belts.

2. The roll-up machine of claim 1 further comprising a toe plate at said entry zone which shields said compressible material from contacting one of said three continuous belts running in a direction opposite said feed direction and which does not allow said compressible material to de-compress or expand as it is fed into said circular cavity.

3. The roll-up machine of claim 2 wherein one of said three continuous belts and its associated forming rollers, driving means and tension means, form a system which is mounted on a subframe, said subframe being translatable towards and away from the others of said continuous belts, allowing a compressed rolls to be ejected by translating said subframe away from said the others of said continuous belts.

4. The roll-up machine of claim 3 wherein said subframe is mounted on wheels, and the position of said subframe is controlled by a pneumatic cylinder and a suitable control algorithm.

5. The roll-up machine of claim 2 where said six forming rollers are distributed around said circular cavity such that each of said three continuous belt segments is responsible for approximately 120-degrees of said circular cavity.

6. The roll-up machine of claim 2 where the gap between forming rollers of adjacent continuous belts is constant as the diameter of said circular cavity changes.

7. The roll-up machine of claim 6 wherein each said forming roller is mounted in its own set of linear guides, and a hydraulic cylinder is used to position each said forming roller.

8. The roll-up machine of claim 6 wherein two of said forming rollers are stationary and four of said forming rollers are mounted in linear tracks, said six forming rollers having an initial arrangement wherein they are evenly spaced about a circular configuration.

9. The roll-up machine of claim 8 wherein said four travelling forming rollers follow rectilinear paths at 25–45 degrees to the horizontal.

10. The roll-up machine of claim 8 wherein said four travelling forming rollers follow linear paths at 30 degrees to the horizontal.

11. The roll-up machine of claim 10 wherein the position of said forming rollers is changed as a function of the linear quantity of material fed into said roll-up machine.

12. The roll-up machine of claim 11 wherein the position of each of said travelling rollers is positioned by an hydraulic cylinder, controlled by a control algorithm.

13. The roll-up machine of claim 12 wherein said control algorithm increases the tension on said three continuous belts as the diameter of the circular cavity increases, thereby maintaining a substantially constant pressure on the compressible material.

14. The roll-up machine of claim 12 further comprising a take-up system to manage belt slack that arises when a roll is ejected, said take-up system including an air cylinder.

15. The roll-up machine of claim 12 further comprising a take-up system to manage belt slack that arises when a roll is ejected, said take-up system including a spring.

16. The roll-up machine of claim 2 wherein one of said three continuous belts and its associated forming rollers, driving means and tension means, form a system which is mounted on a subframe, said subframe being rotatable away from said circular cavity, allowing compressed rolls to be ejected by rotating said subframe away from said others of said continuous belts.

17. The roll-up machine of claim 2 further comprising a take-up system to manage belt slack that arises when a roll is ejected.

18. The roll-up machine of claim 2 in which said means for feeding comprises a horizontal conveyor belt.

19. The roll-up machine of claim 18 further comprising means for pre-compressing said compressible material prior to entering said circular cavity.

20. The roll-up machine of claim 19 in which said means for feeding further comprises an inclined belt for compressing said compressible material against said horizontal conveyor belt, wherein said compressible material is increasingly compressed between said inclined belt and said horizontal conveyor belt as said compressible material moves towards said circular cavity.

21. The roll-up machine of claim 20 in which said horizontal conveyor belt is adapted with apertures improving removal of air from the compressible material as said compressible material moves towards said circular cavity.

22. The roll-up machine of claim 21 in which said apertures are operatively connected to a source of negative gauge pressure to assist in removal of air from said compressible material.

23. The roll-up machine of claim 20 in which said inclined conveyor belt is adapted with apertures improving removal of air from the compressible material as said compressible material moves towards said circular cavity.

24. The roll-up machine of claim 18 in which said means for feeding further comprises a flip-flop conveyor which is rotatable between two positions, a first position in which it is in-line with said horizontal conveyor belt and a second position in which it is rotated out of the path of said horizontal conveyor belt, providing additional clearance for the movement of said continuous belts.

25. The roll-up machine of claim 2 wherein said six rollers follow rectilinear paths.

26. The roll-up machine of claim 25 wherein the system consisting of all three of said continuous belts and their associated forming rollers, driving means and tension means, is translatable towards and away from said means for feeding as the diameter of the roll increases.

27. A method of operation for a roll-up machine for rolling up a compressible material, said roll-up machine including three continuous belts defining a circular cavity, each of said three continuous belts providing only a portion of the circumference of said circular cavity, and six sufficiently stiff forming rollers, two for each of said three continuous belts, for defining said circular cavity, said method comprising the steps of:

putting said three continuous belts under a desired level of tension;

driving said three continuous belts to rotate said compressible material within said circular cavity;

feeding said compressible material into said circular cavity, through an entry zone between forming rollers of two of said three continuous belts, establishing generally circumferential contact with said compressible material so that said compressible material is under compressive pressure as it is being rolled; and coordinating the positions of said six forming rollers, to maintain the shape of said circular cavity as said compressible material is fed into said circular cavity.

* * * * *